US010181688B1

(12) United States Patent
Shimada et al.

(10) Patent No.: US 10,181,688 B1
(45) Date of Patent: Jan. 15, 2019

(54) QUICK DISCONNECT ELECTRICAL CABLE CONNECTOR

(71) Applicant: Cisco Technology, Inc., San Jose, CA (US)

(72) Inventors: Naoki Shimada, Milpitas, CA (US); Victor Manuel Sanchez, San Jose, CA (US); David M. Sanguinet, San Jose, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 15/850,438

(22) Filed: Dec. 21, 2017

(51) Int. Cl.

| | |
|---|---|
| ***H01R 13/28*** | (2006.01) |
| ***H01R 24/84*** | (2011.01) |
| ***H01R 24/62*** | (2011.01) |
| *H01R 107/00* | (2006.01) |

(52) U.S. Cl.
CPC ..... *H01R 24/84* (2013.01); *H01R 13/28* (2013.01); *H01R 24/62* (2013.01); *H01R 23/27* (2013.01); *H01R 2107/00* (2013.01)

(58) Field of Classification Search
CPC ..... H01R 24/84; H01R 13/28; H01R 23/27
USPC ..... 439/284
See application file for complete search history.

(56) References Cited

U.S. PATENT DOCUMENTS

| | | | | |
|---|---|---|---|---|
| 3,634,811 | A | 1/1972 | Teagno et al. | |
| 3,638,164 | A | 1/1972 | Glance et al. | |
| 4,634,211 | A * | 1/1987 | Poliak | H01R 4/44 439/106 |
| 4,737,118 | A | 4/1988 | Lockard | |
| 5,259,780 | A | 11/1993 | Morrissey et al. | |
| 5,448,646 | A | 9/1995 | Lucey et al. | |
| 5,575,674 | A * | 11/1996 | Davis | H01R 24/84 439/284 |
| 5,800,196 | A | 9/1998 | Rudoy et al. | |
| 7,220,136 | B1 * | 5/2007 | Green | H01R 25/00 439/106 |
| 7,513,782 | B1 * | 4/2009 | Sheldon | H01R 13/652 439/106 |
| 7,828,587 | B2 | 11/2010 | Hermant et al. | |
| 7,955,109 | B2 | 6/2011 | Toner | |
| 9,246,286 | B2 * | 1/2016 | Stowers | H01R 13/514 |
| 9,337,594 | B2 | 5/2016 | Brodsgaard | |
| 2009/0181571 | A1 | 7/2009 | Willing et al. | |

* cited by examiner

*Primary Examiner* — Tho D Ta
(74) *Attorney, Agent, or Firm* — Edell, Shapiro & Finnan, LLC

(57) ABSTRACT

A hermaphroditic electrical connector having a first connector half and a second connector half configured to mate with one another. Each of the connector halves includes a housing, a first projection, a second projection, and a central protrusion. The housing includes a first side, an opposite second side, a top side, and an opposite bottom side. The first projection extends from the first side of the housing proximate to the top side of the housing. The second projection extends from the first side of the housing proximate to the top side of the housing such that the first and second projections are spaced from one another by a slot. The central protrusion extends from the first side of the housing proximate to the bottom side of housing.

20 Claims, 19 Drawing Sheets

QUICK DISCONNECT ELECTRICAL CABLE CONNECTOR

TECHNICAL FIELD

The present disclosure relates to an electrical connector.

BACKGROUND

Electrical connectors are used to connect two cables to one another. Cables may be provided with quick disconnect connectors to enable the cable to be temporarily disconnected and reconnected to one another. Telephone headsets, which are used during communication sessions, include connectors that enable the headsets to quickly connect to cables of telephones or other collaboration equipment. Conventional quick disconnect connectors may have a specific gender (i.e., a female connector configured to receive a male connector) or may be genderless connectors (i.e., hermaphroditic connectors). Some quick disconnect connectors, because of their ability to be quickly connected and disconnected to each other, may not be capable of providing a continuous and affirmative electrical contact with one another.

BRIEF DESCRIPTION OF THE DRAWINGS

Like reference numerals have been used to identify like elements throughout this disclosure.

DESCRIPTION OF EXAMPLE EMBODIMENTS

Overview

In one embodiment, a hermaphroditic quick disconnect electrical connector is provided. The connector may include a housing, a first projection, a second projection, and a central protrusion. The housing may include a first side, an opposite second side, a top side, and an opposite bottom side. The first projection may extend from the first side of the housing proximate to the top side of the housing. The second projection may also extend from the first side of the housing proximate to the top side of the housing. However, the first and second projections may be spaced from one another by a slot. The central protrusion may extend from the first side of the housing proximate to the bottom side of housing.

Example Embodiments

The quick disconnect electrical cable connector described herein is a connector having two identical housing halves that are configured to mate with one another to provide a continuous and affirmative electrical connection between two cables. The embodiment of the connector described herein is configured to facilitate the quick connection and/or disconnection of the two housing halves. The connector halves are identical in size and shape, and each includes a keyed structure that is configured to intermesh with an identical connector half. Moreover, this hermaphroditic keyed structure enables two connector halves to securely mate with one another. The keyed structure of the connector halves, once intermeshed with each other, prevents the connector halves from sliding apart without a user applying some degree of force to the connector halves. Thus, the connector described herein provides a continuous and affirmative electrical contact between each other while still enabling a user to quickly connect or disconnect the two halves of the connector from one another.

Figure 1:
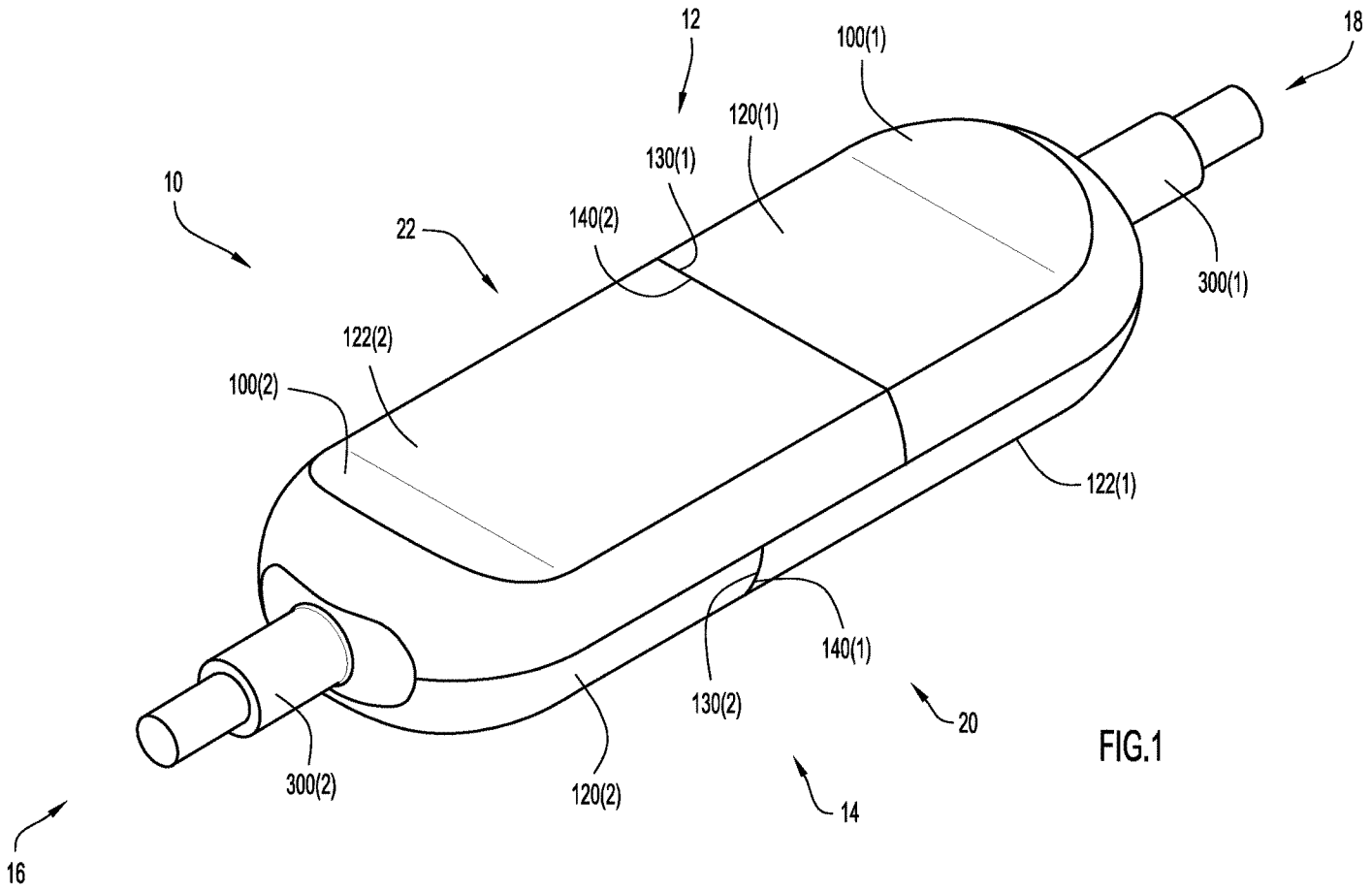
FIG. 1 is a perspective view of a hermaphroditic quick disconnect electrical connector, according to an example embodiment.
Figure 2:
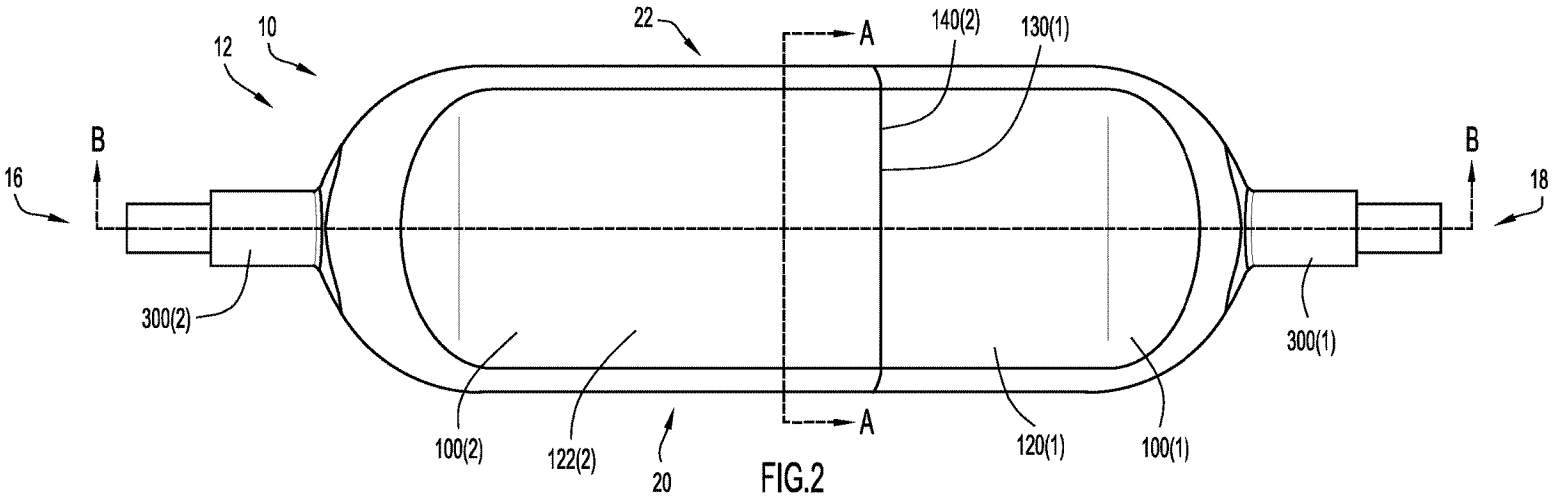
FIG. 2 is a top view of the hermaphroditic quick disconnect electrical connector illustrated in FIG. 1.
Figure 3:
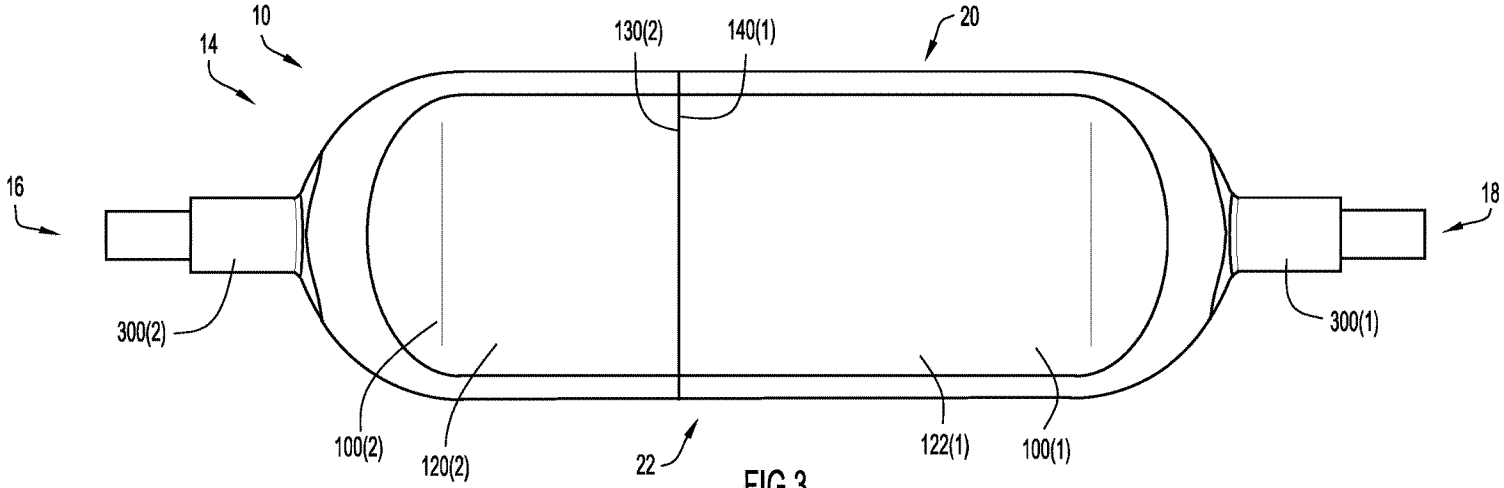
FIG. 3 is a bottom view of the hermaphroditic quick disconnect electrical connector illustrated in FIG. 1.
Figure 4:
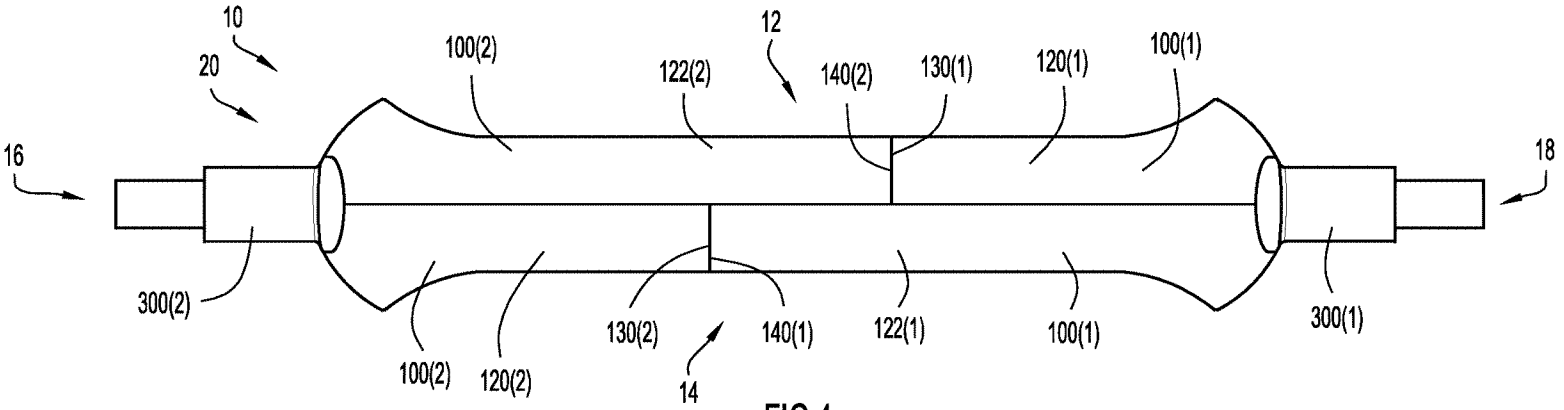
FIG. 4 is a first side view of the hermaphroditic quick disconnect electrical connector illustrated in FIG. 1.
Figure 5:
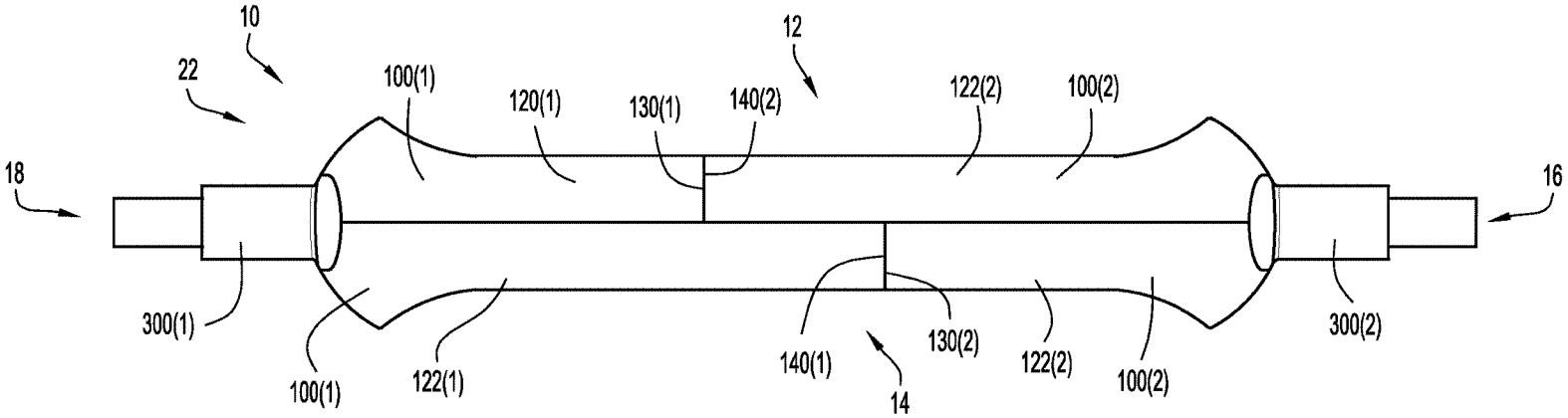
FIG. 5 is a second side view of the hermaphroditic quick disconnect electrical connector illustrated in FIG. 1.
Figure 7:
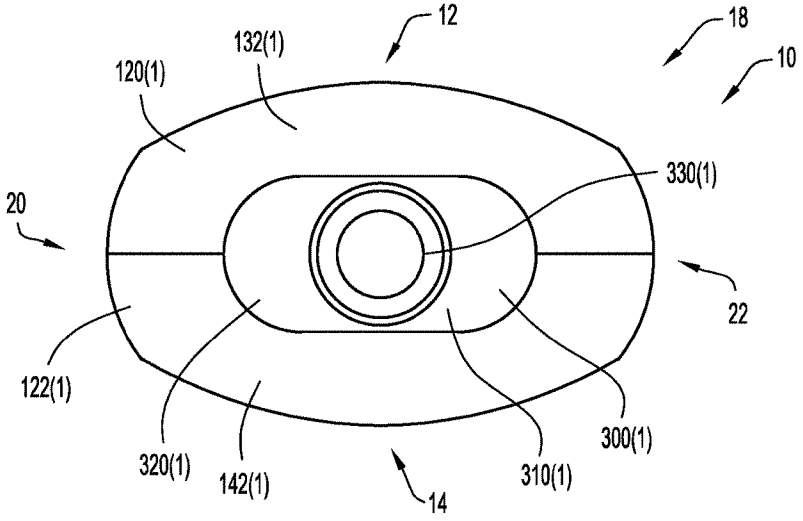
FIG. 7 is a rear view of the hermaphroditic quick disconnect electrical connector illustrated in FIG. 1.
Figure 6:
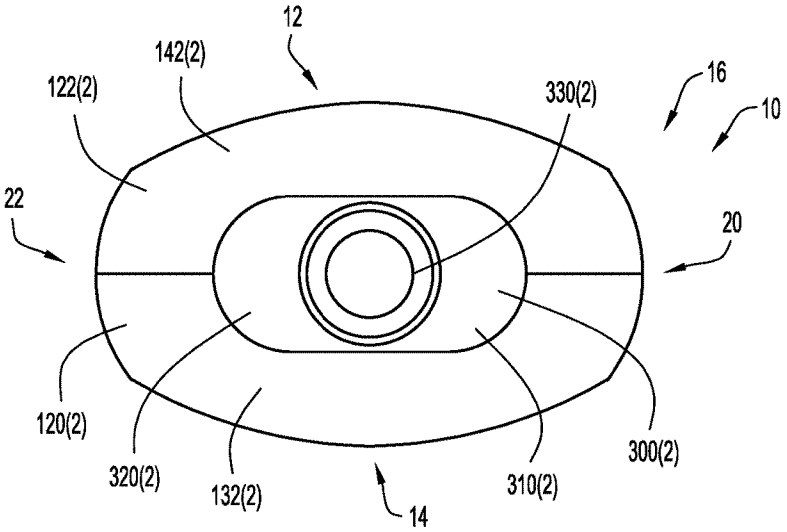
FIG. 6 is a front view of the hermaphroditic quick disconnect electrical connector illustrated in FIG. 1.

With reference to FIGS. 1-7, illustrated is a hermaphroditic quick disconnect electrical connector 10. As illustrated, the connector 10 includes a top side 12, a bottom side 14 opposite the top side 12, a front side 16, and a rear side 18 opposite the front side 16. The connector 10 further includes a first (e.g., right) side 20, and a second (e.g., left) side 22 opposite the first side 20. The connector 10 consists of a first connector half 100(1) and a second connector half 100(2) that are configured to connect to one another. FIGS. 1-7 illustrate the connector 10 with the first connector half 100(1) and the second connector half 100(2) intermeshed with one another to form the fully assembled connector 10. FIG. 1 illustrates a perspective view of the connector 10. FIG. 2 illustrates a top view of the connector 10, which shows the top side 12 of the connector 10. Conversely, FIG. 3 illustrates a bottom view of the connector 10, which shows the bottom side 14 of the connector 10. Furthermore, FIG. 4 illustrates an elevational view of the first side 20 of the connector 10, while FIG. 5 illustrates an elevational view of the second side 22 of the connector 10. In addition, FIG. 6 illustrates an elevational view of the front side 16 of the connector 10, while FIG. 7 illustrates an elevational view of the rear side 18 of the connector 10.

As best illustrated in FIGS. 1-5, the connector 10 may have a generally rectangular prismatic shape with curved ends when the two halves 100(1), 100(2) are connected to one another. In other embodiments, the connector 10 may be formed in any other shape when the two halves 100(1), 100(2) are connected to one another.

With reference to FIGS. 8-16, illustrated is the first connector half 100(1). While FIGS. 8-16 only illustrate the first connector half 100(1), because the first and second connector halves 100(1), 100(2) are identical to one another, and because the connector halves 100(1), 100(2) are configured to mate with one another (i.e., the two connector halves 100(1), 100(2) are hermaphroditic), the description of the first connector half 100(1) also applies to the second connector half 100(2).

Figure 8:
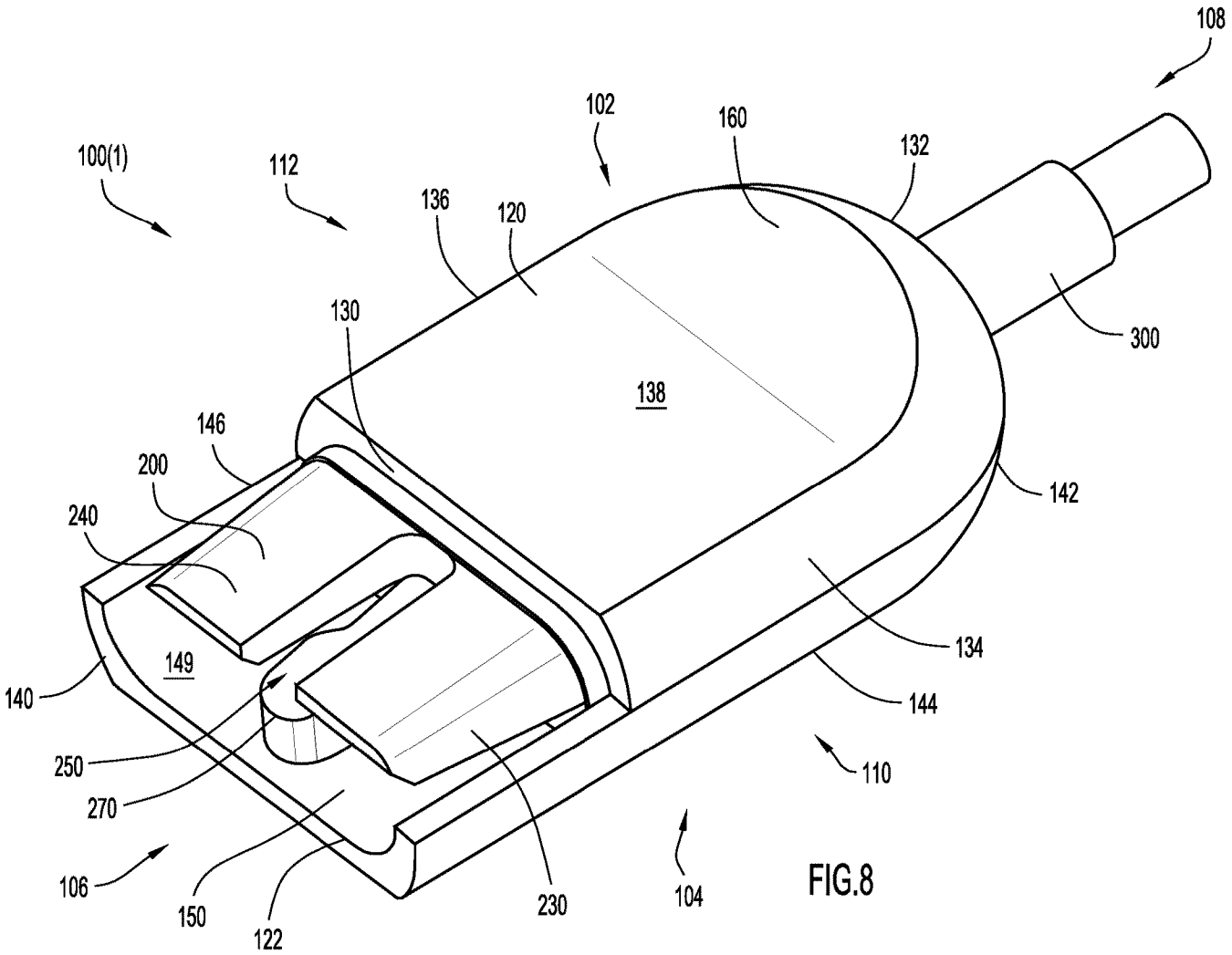
FIG. 8 is a top perspective view of a connector half of the hermaphroditic quick disconnect electrical connector illustrated in FIG. 1.
Figure 9:
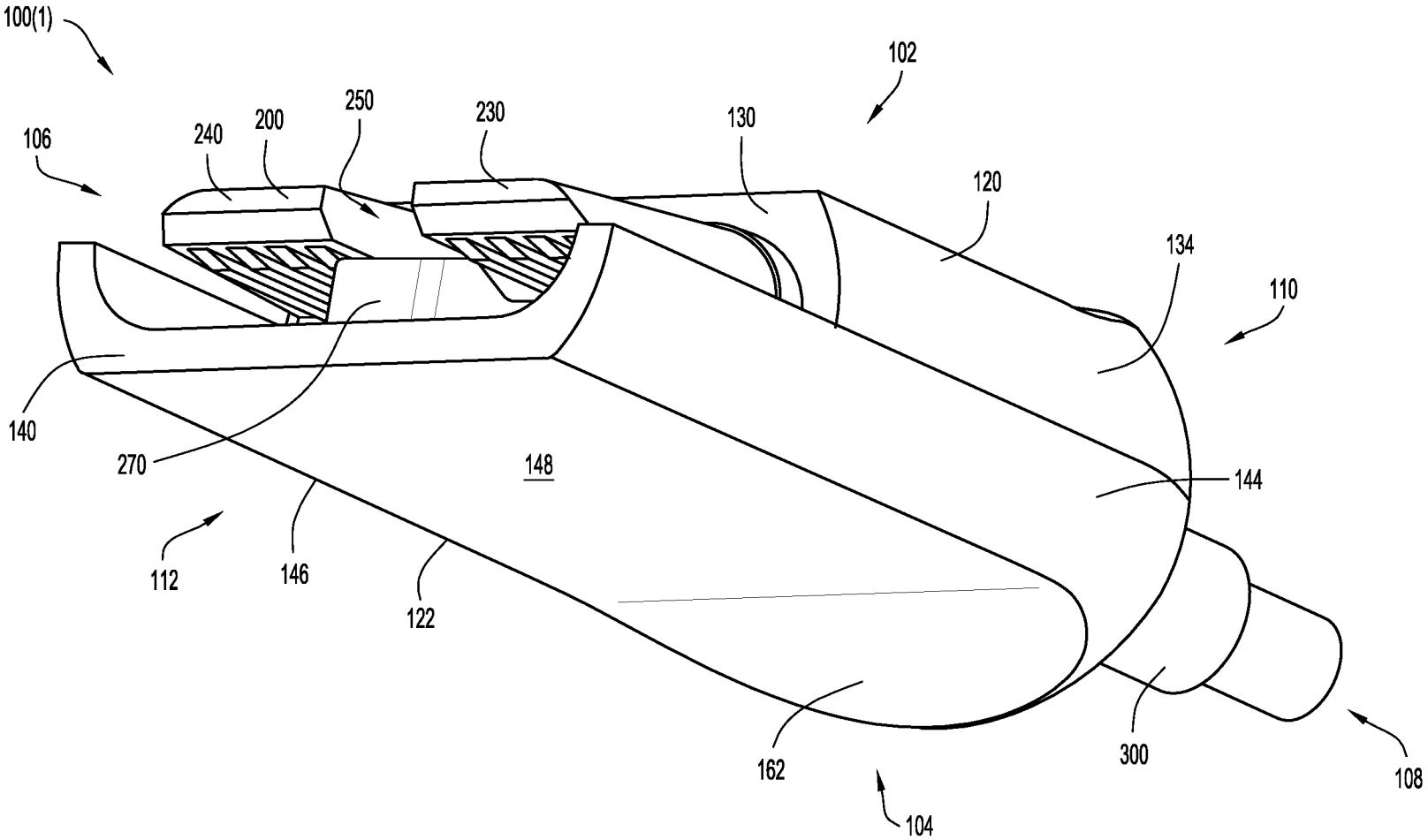
FIG. 9 is a bottom perspective view of the connector half illustrated in FIG. 8.
Figure 10:
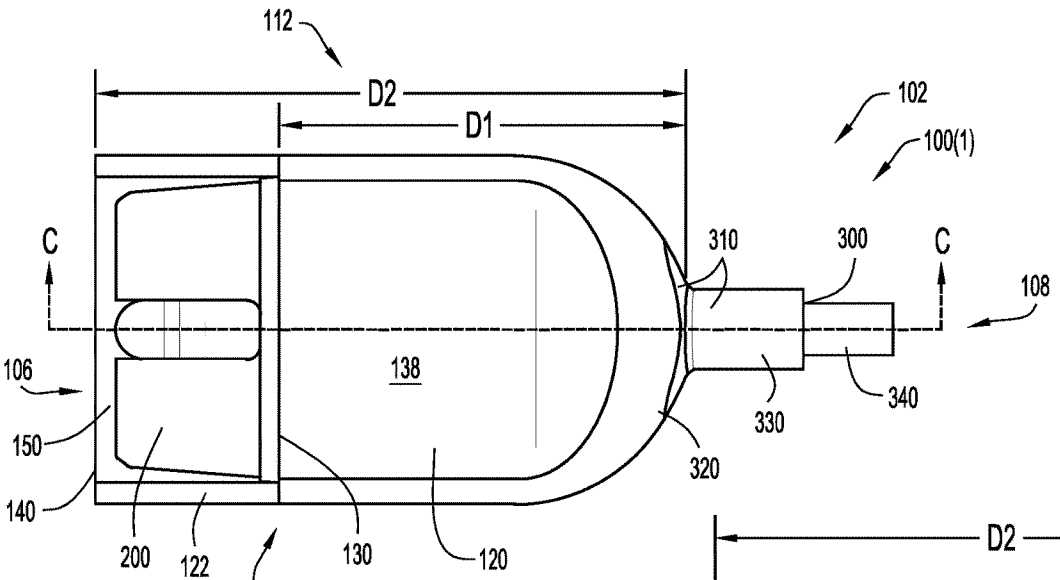
FIG. 10 is a top view of the connector half illustrated in FIG. 8.
Figure 11:
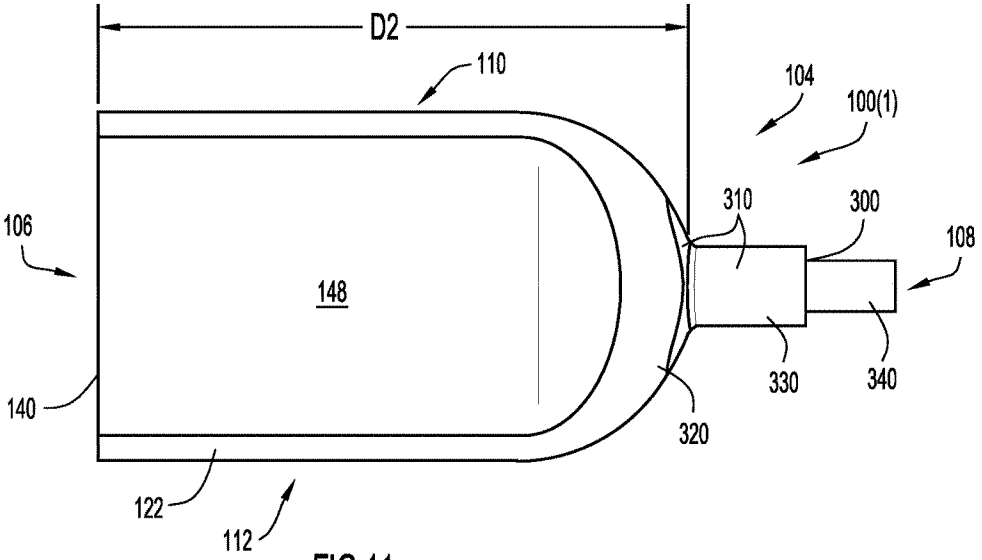
FIG. 11 is a bottom view of the connector half illustrated in FIG. 8.
Figure 12:
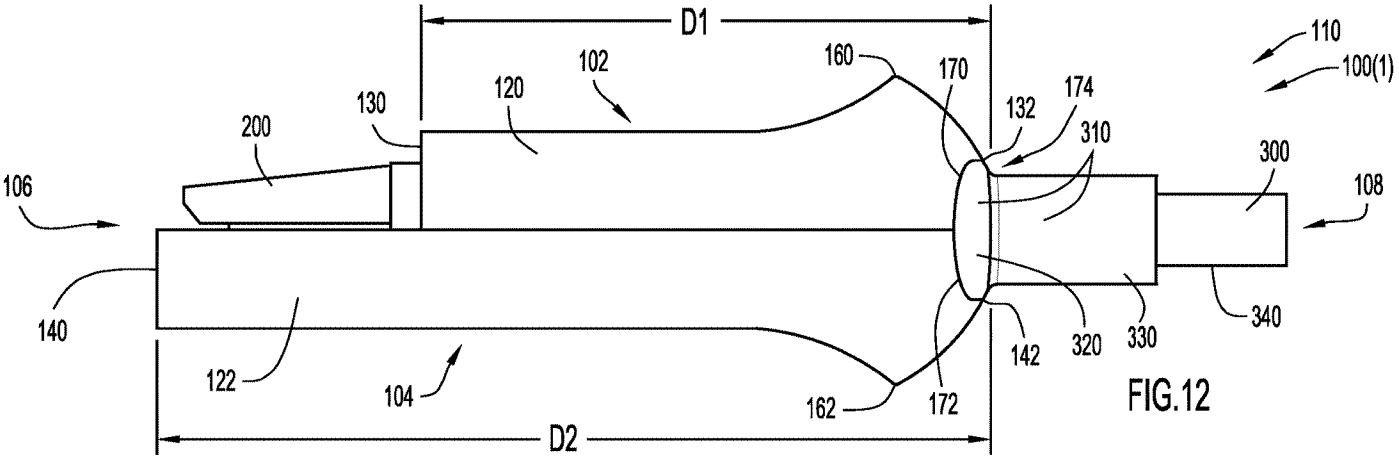
FIG. 12 is a first side view of connector half illustrated in FIG. 8.
Figure 13:
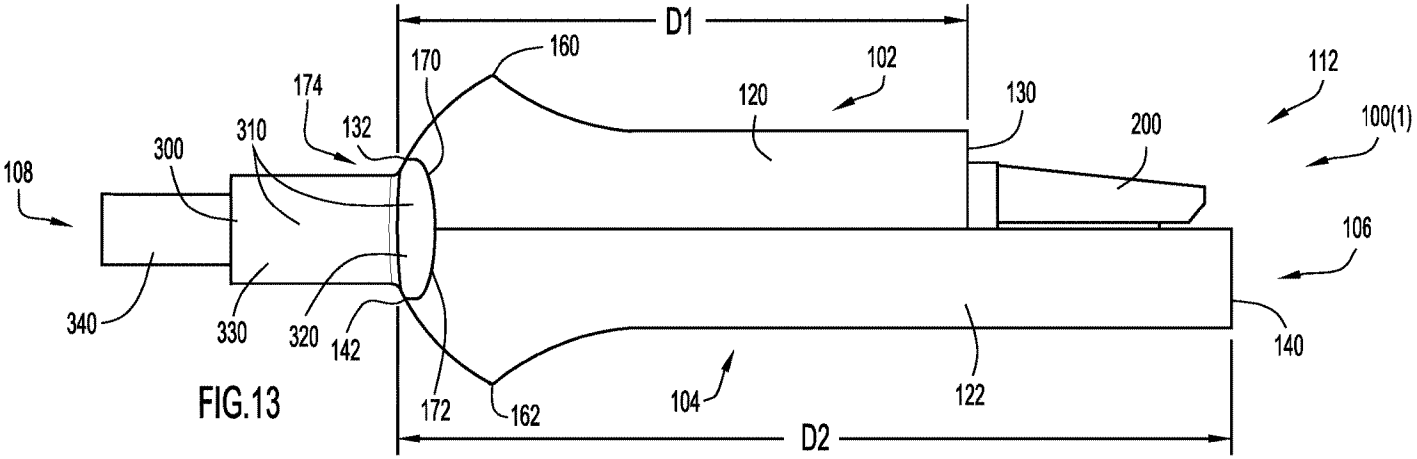
FIG. 13 is a second side view of the connector half illustrated in FIG. 8.
Figure 15:
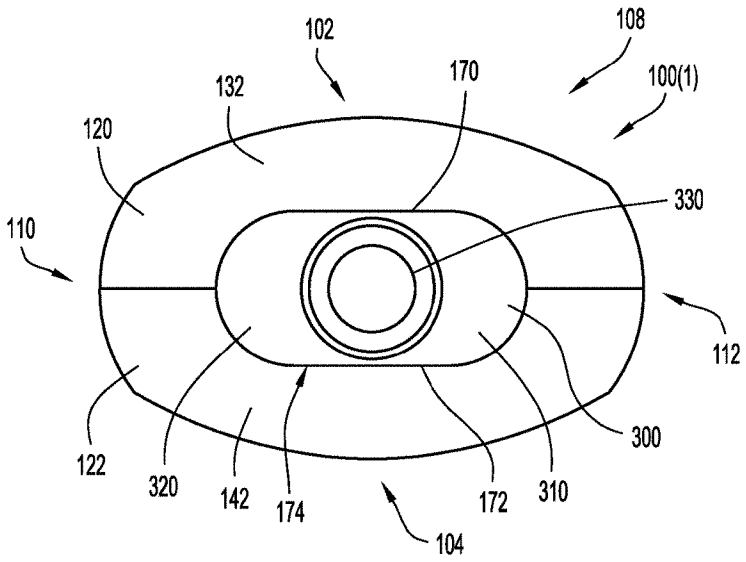
FIG. 15 is a rear view of the connector half illustrated in FIG. 8.
Figure 14:
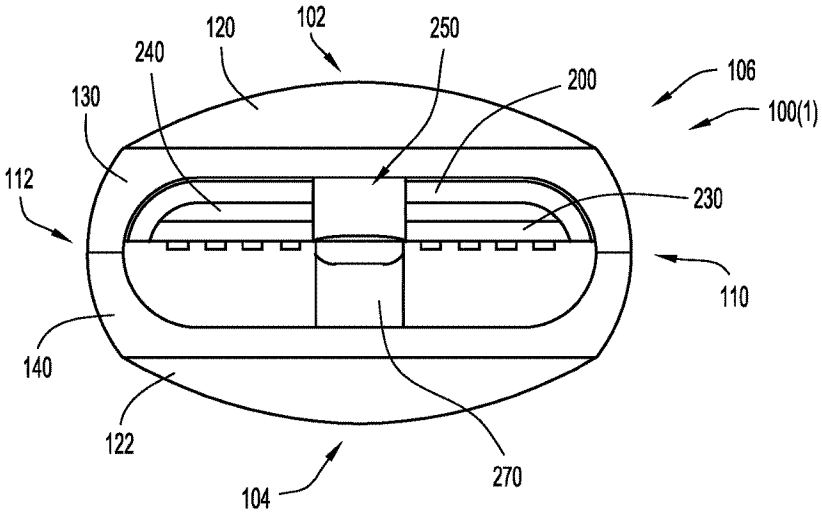
FIG. 14 is a front view of the connector half illustrated in FIG. 8.
Figure 16:
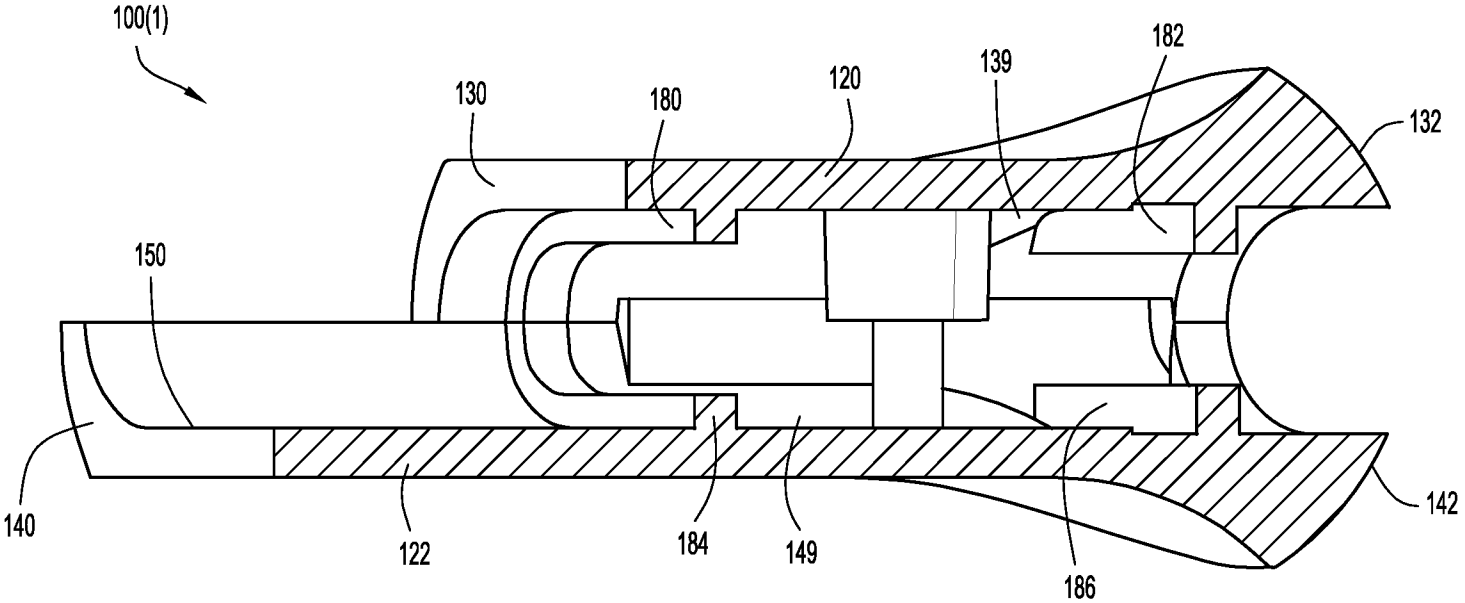
FIG. 16 is a cross-sectional view of the connector half illustrated in FIG. 8 taken along line C-C of FIG. 10 with the pin housing and cable coupling removed from the connector half.

As illustrated in FIGS. 8-16, the first connector half 100(1) includes a top side 102, a bottom side 104 opposite the top side 102, a front side 106, and a rear side 108 opposite the front side 106. The first connector half 100(1) further includes a first (e.g., right) side 110, and a second (e.g., left) side 112 opposite the first side 110. Furthermore, the first connector half 100(1) includes a first, or top, housing 120 and a second, or bottom, housing 122. FIG. 8 illustrates a top perspective view of the first connector half 100(1), while FIG. 9 illustrates a bottom perspective view the first connector half 100(1). FIG. 10 illustrates a top view of the first connector half 100(1), and shows the top side 102 of the first connector half 100(1). Conversely, FIG. 11 illustrates a bottom view of the first connector half 100(1), and shows the bottom side 104 of the first connector half 100(1). Furthermore, FIG. 12 illustrates an elevational view of the first side 110 of the first connector half 100(1), while FIG. 13 illustrates an elevational view of the second side 112 of the first connector half 100(1). In addition, FIG. 14 illustrates an elevational view of the front side 106 of the first connector half 100(1), while FIG. 15 illustrates an elevational view of the rear side 108 of the first connector half 100(1). FIG. 16 illustrates a cross-sectional view of the first connector half 100(1) taken along line C-C of FIG. 10, where some components of the first connector half 100(1) are removed for illustrative purposes only.

The first housing 120 includes a first end 130 and an opposite second end 132. The first housing 120 further includes a first side 134 that spans between the first end 130 and the second end 132, and an opposing second side 136 that also spans between the first end 130 and the second end 132 of the first housing 120. The first housing 120 also includes an exterior surface 138 (best illustrated in FIGS. 8 and 10) and an interior surface 139 (best illustrated in FIG. 16). Similarly, the second housing 122 includes a first end 140 and an opposite second end 142. The second housing 140 further includes a first side 144 that spans between the first end 140 and the second end 142, and an opposing second side 146 that also spans between the first end 140 and the second end 142 of the second housing 122. The second housing 122 also includes an exterior surface 148 (best illustrated in FIGS. 9 and 11) and an interior surface 149 (best illustrated in FIG. 16). The two housings 120, 122 are connected to one another such that the interior surface 139 of the first housing 120 faces the interior surface 149 of the second housing 122. Moreover, when connected to one another, the second end 132 of the first housing 120 is aligned with the second end 142 of the second housing 122 to form the curved rear side 108 of the first connector half 100(1).

As illustrated in FIGS. 10-13, the length D1 of the first housing 120 (i.e., the distance between the first end 130 and the second end 132 of the first housing 120) is less than the length D2 of the second housing 122. Moreover, the second end 132 of the first housing 120 and the second end 142 of the second housing 122 are aligned with one another. Thus, because the second housing 122 has a length of D2 that is longer than the length D1 of the first housing 120, the first end 140 of the second housing 122 extends beyond the first end 130 of the first housing 120. As illustrated in FIG. 10, because the first end 140 of the second housing 122 extends beyond the first end 130 of the first housing 120, a portion of the interior surface 149 of the second housing 122 is exposed. This exposed portion of the second housing 122 forms a platform 150.

As best illustrated in FIGS. 12-14, the exterior surface 138 of the first housing 120 includes a flared or ramp portion 160, while the exterior surface 148 of the second housing 122 also includes a flared or ramp portion 162. The exterior surface 138 of the first housing 120 includes a portion that curves outward from the top of the first housing 120 to create the ramp portion 160 such that the ramp portion 160 is disposed proximate to the second end 132 of the first housing 120. Similarly, the exterior surface 148 of the second housing 122 includes a portion that curves outward from the top of the second housing 120 to form the ramp portion 162 such that the ramp portion 162 is disposed proximate to the second end 142 of the second housing 122. With the housings 120, 122 coupled to one another, the ramp portions 160, 162 are disposed opposite of one another such that the first ramp portion 160 extends from the top 102 of the first connector half 100(1), and the second ramp portion 162 extends from the bottom 104 of the first connector half 100(1). In other words, the first and second ramp portions 160, 162 extend in opposite directions from one another. The formation and orientation of the ramp portions 160, 162 enable a user to more easily grip the first connector half 100(1) between their fingers (i.e., between their thumb and index fingers) when pulling the first connector half 100(1) away from the second connector half 100(2).

As best illustrated in FIGS. 12, 13, and 15, the first housing 120 includes a cut-out portion 170 disposed in the second end 132 of the first housing 120. Similarly, the second housing 122 also includes a cut-out portion 172 disposed in the second end 142 of the second housing 122. The cut-out portion 170 of the first housing 120 aligns with the cut-out portion 172 of the second housing 122 to create an opening 174 on the rear side 108 of the first connector half 100(1).

Turning to FIG. 16, the interior surface 139 of the first housing 120 includes a forward protuberance 180 and a rearward protuberance 182. The forward protuberance 182 of the first housing 120 is disposed proximate to the first end 130 of the first housing 100, while the rearward protuberance 182 is disposed proximate to the second end 132 of the first housing 100. Similarly, the interior surface 149 of the second housing 122 also includes a forward protuberance 184 and a rearward protuberance 186. The forward protuberance 184 of the second housing 122 is disposed approximately halfway between the first end 140 and the second end 142 along the interior surface 149 of the second housing 122. As illustrated, the forward protuberance 184 of the second housing 122 is aligned with the forward protuberance 180 of the first housing 120 such that the two forward protuberances 180, 184 collectively form a continuous protuberance extending around an interior of the first connector half 100(1). Additionally, the rearward protuberance 186 of the second housing 122 is disposed proximate the second end 142 of the second housing 122. The rearward protuberance 186 of the second housing 122 is aligned with the rearward protuberance 182 of the first housing 120 such that the two rearward protuberances 182, 186 collectively form a continuous protuberance extending around an interior of the first connector half 100(1) proximate to the rear side 108 of the first connector half 100(1).

As illustrated in FIGS. 8-15, coupled to the first connector half 100(1) proximate to the front side 106 of the first connector half 100(1) is a pin housing 200. As illustrated, the pin housing 200 is at least partially exposed on the first side 106 of the first connector half 100(1). More specifically, the pin housing 200 may extend from the first end 130 of the first housing 120, but may not extend beyond the first end 140 of the second housing 122. Thus, the pin housing 200 may extend from the first end 130 of the first housing 120, through or over the platform 150 of the second housing 122, but not beyond the first end 140 of the second housing 122. The pin housing 200 is described in more detail below in connection with FIGS. 17-24.

Figure 17:
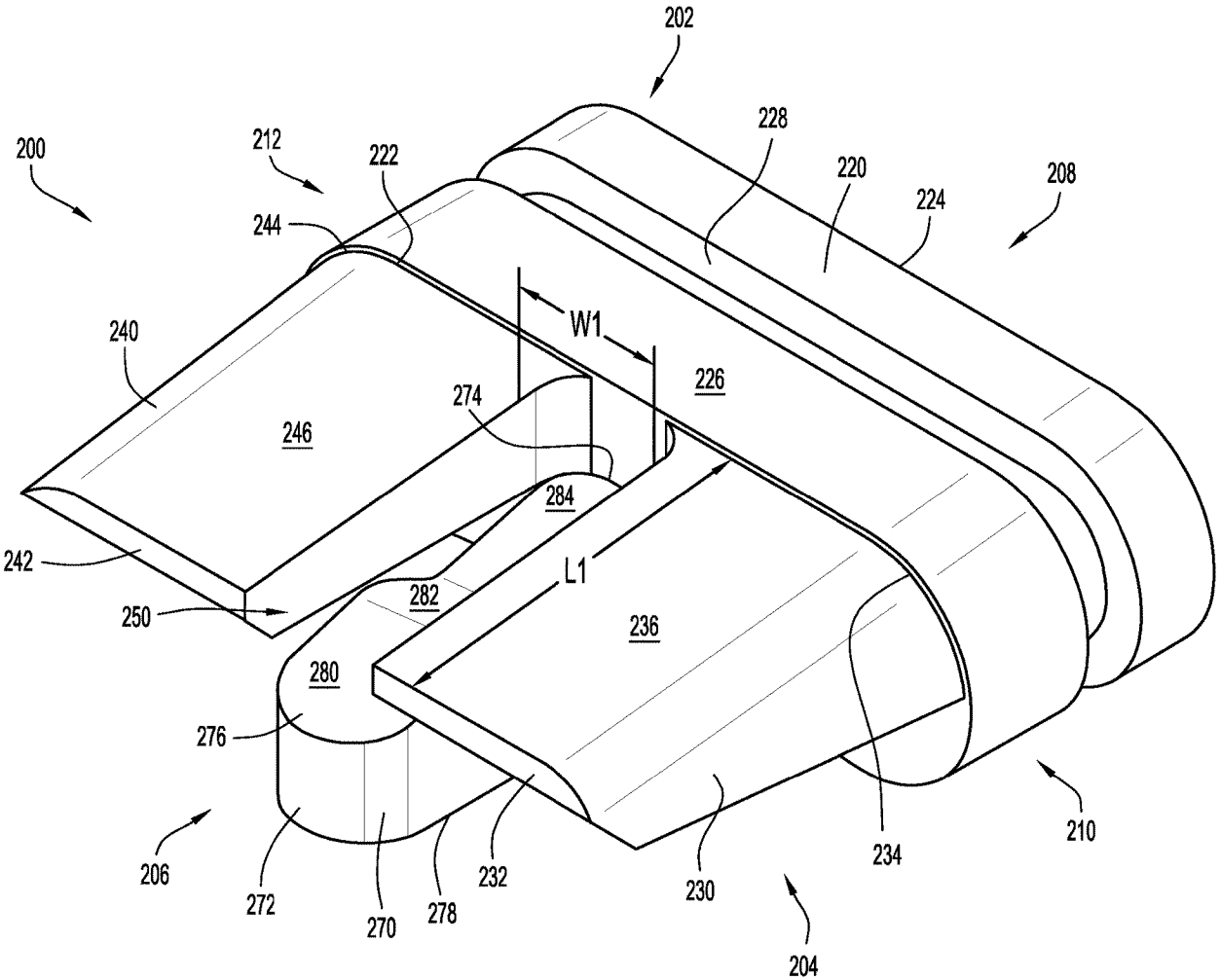
FIG. 17 is a top perspective view of a pin housing of the hermaphroditic quick disconnect electrical connector illustrated in FIG. 1.
Figure 18:
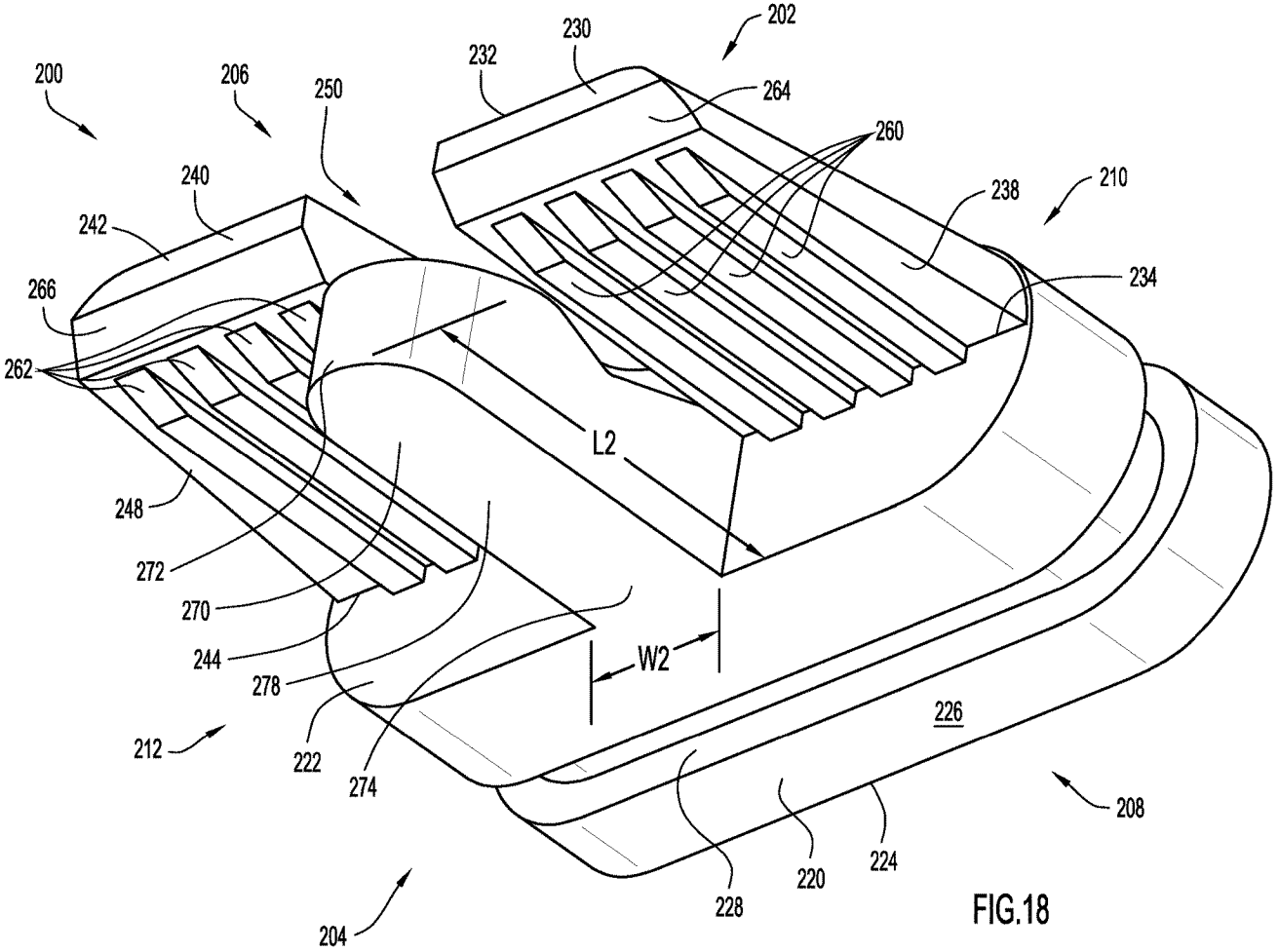
FIG. 18 is a bottom perspective view of the pin housing illustrated in FIG. 17.
Figure 20:
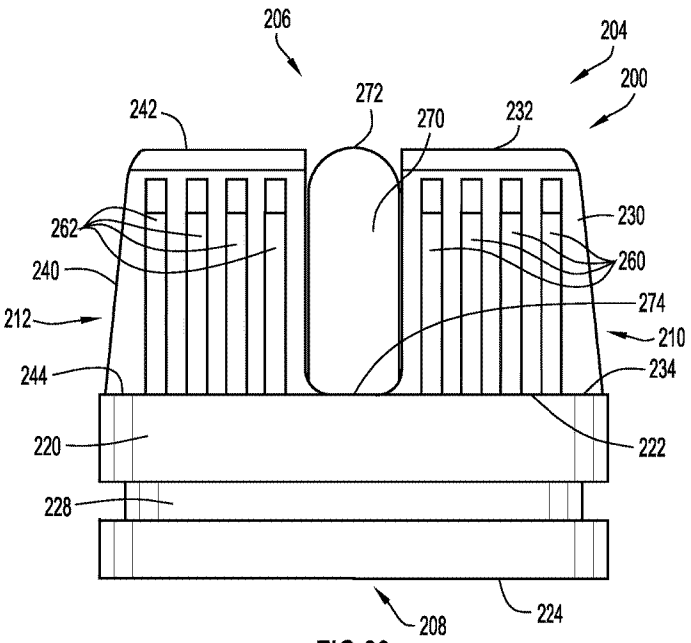
FIG. 20 is a bottom view of the pin housing illustrated in FIG. 17.
Figure 19:
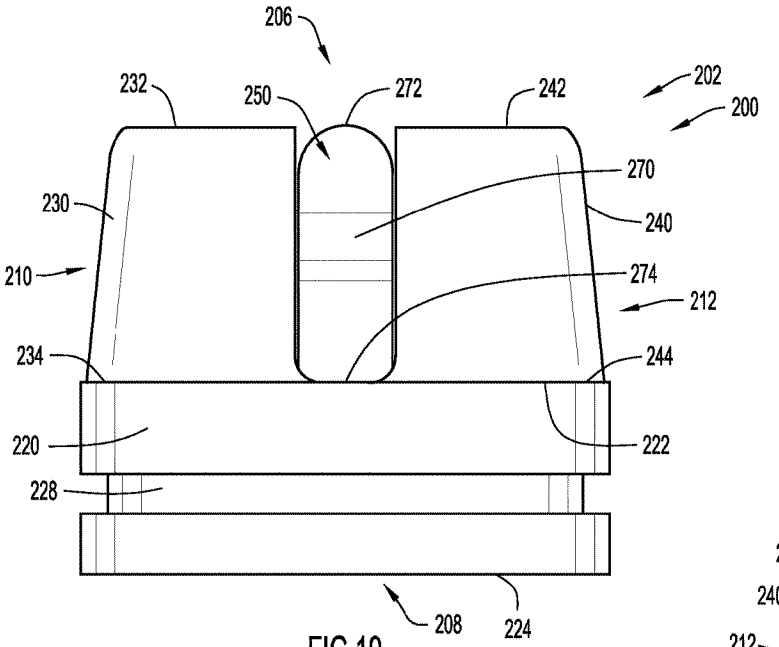
FIG. 19 is a top view of the pin housing illustrated in FIG. 17.
Figure 21:
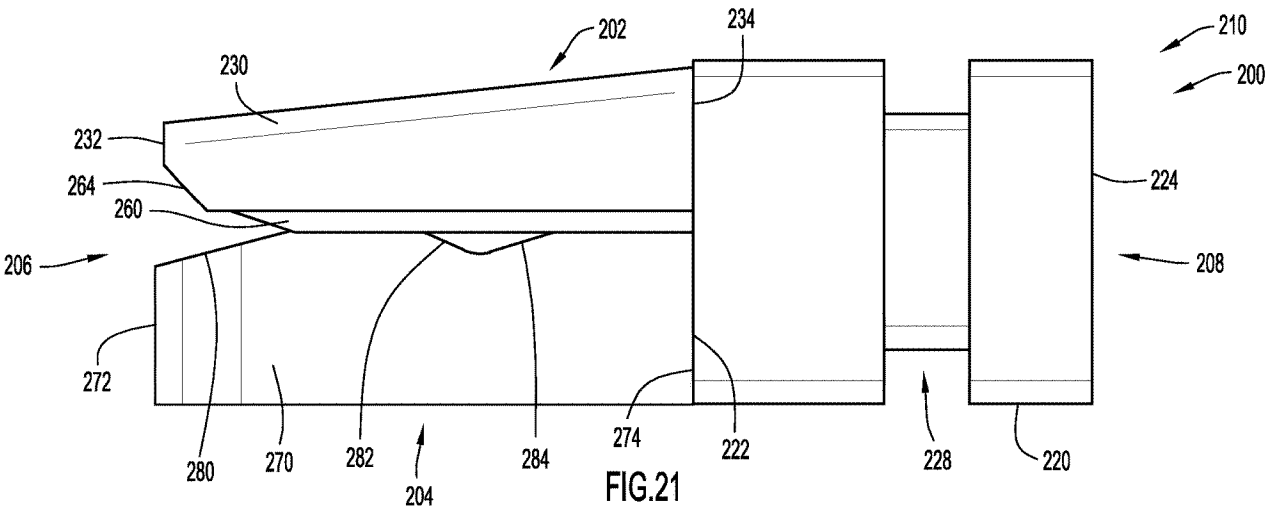
FIG. 21 is a first side view of the pin housing illustrated in FIG. 17.
Figure 22:
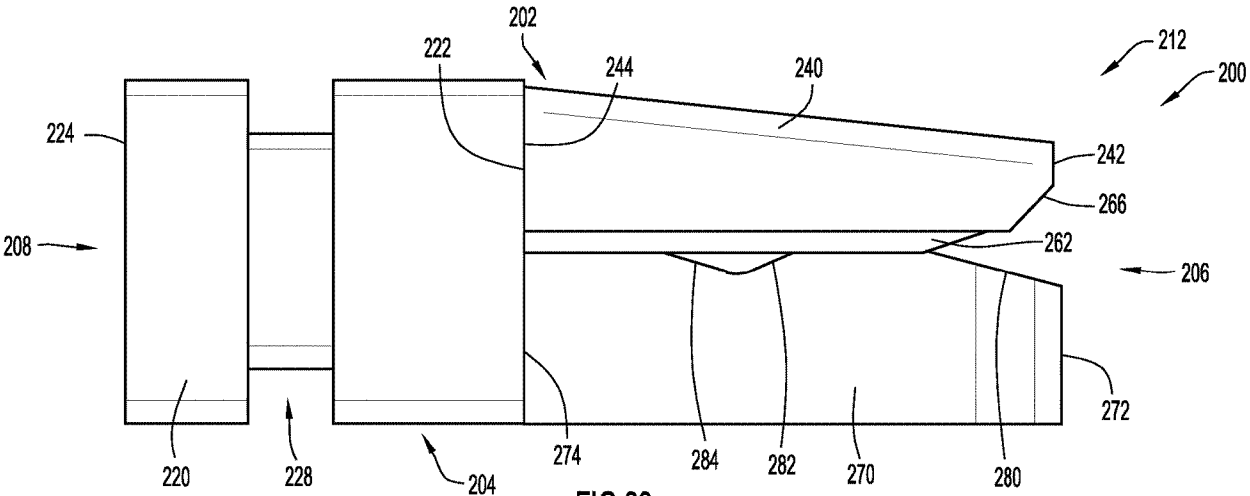
FIG. 22 is a second side view of the pin housing illustrated in FIG. 17.
Figure 23:
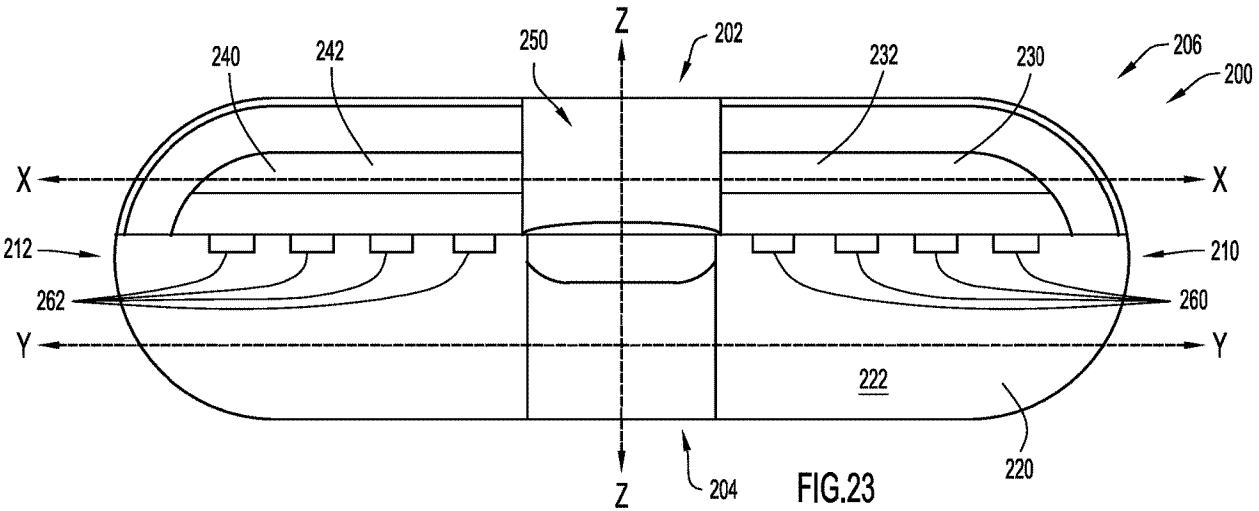
FIG. 23 is a front view of the pin housing illustrated in FIG. 17.
Figure 24:
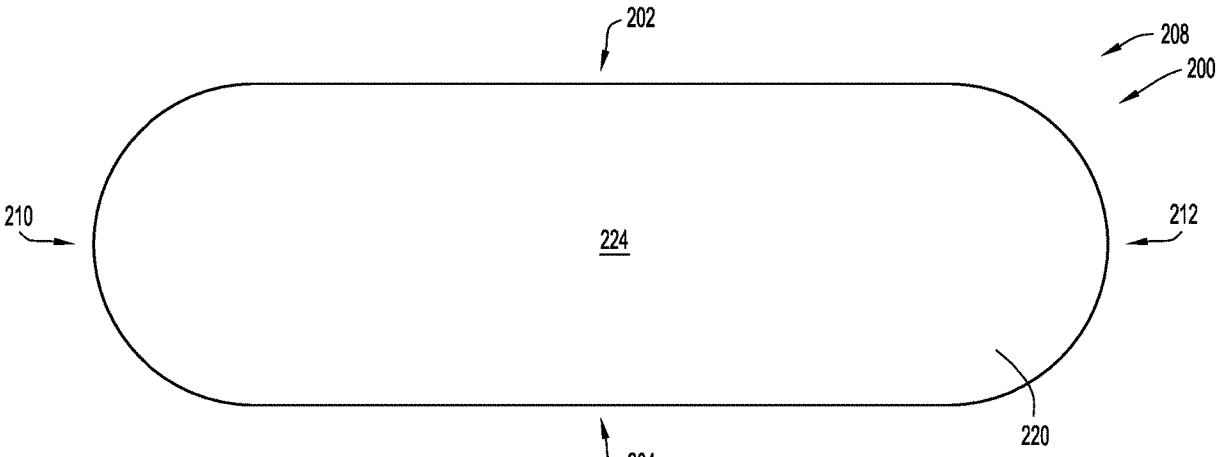
FIG. 24 is a rear view of the pin housing illustrated in FIG. 17.

With reference to FIGS. 17-24, the pin housing 200 includes a top side 202, a bottom side 204 opposite the top side 202, a front side 206, and a rear side 208 opposite the front side 206. The pin housing 200 further includes a first (e.g., right) side 210, and a second (e.g., left) side 212 opposite the first side 210. FIG. 17 illustrates a top perspective view of the pin housing 200, while FIG. 18 illustrates a bottom perspective view the pin housing 200. FIG. 19 illustrates a top view of the pin housing 200, and shows the top side 202 of the pin housing 200. Conversely, FIG. 20 illustrates a bottom view of the pin housing 200, and shows the bottom side 204 of the pin housing 200. Furthermore, FIG. 21 illustrates an elevational view of the first side 210 of the pin housing 200, while FIG. 22 illustrates an elevational view of the second side 212 of the pin housing 200. In addition, FIG. 23 illustrates an elevational view of the front side 206 of the pin housing 200, while FIG. 24 illustrates an elevational view of the rear side 208 of the pin housing 200.

The pin housing 200 includes a base portion 220 disposed proximate to the rear side 208 of the pin housing 200. The base portion 220 includes a first side 222 and an opposite second side 224 and may have a rounded rectangular shape (i.e., substantially rectangular with rounded ends). While the base portion 220 in the illustrated embodiment does contain a rounded rectangular shape, the base portion 220 may be of any other shape (e.g., circular, rectangular, triangular, etc.). The second side 224 of the base portion 220 may form the rear side 208 of the pin housing 200. The first side 222 of the base portion 220 may be disposed between the front and rear sides 206, 208 of the pin housing 200.

With continued reference to FIGS. 17-24, the base portion 220 further includes a sidewall 226 that spans between the first side 222 and the second side 224. A continuous groove 228 may be disposed within the sidewall 226 of the base portion 220 such that the groove 228 is disposed between the first side 222 and the second side 224 of the base portion 220. The groove 228 may continuously span around the base portion 220.

The pin housing 200 further includes a first projection 230. The first projection 230 extends from the first side 222 of the base portion 220 such that the first projection 230 is disposed proximate to the front side 206 and the first side 210 of the pin housing 200. Moreover, the first projection 230 extends from the base portion 220 proximate to the top side 202 of the pin housing 200. The first projection 230 includes a first end 232 and an opposite second end 234. The second end 234 of the first projection 230 is coupled to the first side 222 of the base portion 220, while the first end 232 of the first projection 230 is a free end, uncoupled from the base portion 220. The first projection 230 further includes a top surface 236 and a bottom surface 238 opposite the top surface 236. The first projection 230 may taper in width and thickness in a direction spanning from the second end 234 to the first end 232.

In addition, the pin housing 200 also includes a second projection 240 that is similar to the first projection 230. The second projection 240 extends from the first side 222 of the base portion 220 such that the second projection 240 is disposed proximate to the front side 206 and the second side 212 of the pin housing 200. Moreover, the second projection 240 extends from the base portion 220 proximate to the top side 202 of the pin housing 200. Like the first projection 230, the second projection 240 includes a first end 242 and an opposite second end 244. The second end 244 of the second projection 240 is coupled to the first side 222 of the base portion 220, while the first end 242 of the second projection 240 is a free end, uncoupled from the base portion 220. The second projection 240 further includes a top surface 246 and a bottom surface 248 opposite the top surface 246. The second projection 240 may taper in width and thickness in a direction spanning from the second end 244 to the first end 242.

As illustrated, the first projection 230 and the second projection 240 are spaced from one another by a slot 250. The slot 250 may have a length L1 and a width W1. Because the slot 250 spans the length of the first and second projections 230, 240, the first and second projections 230, 240 may have the same length L1 as the slot 250. As illustrated, because the first projection 230 is disposed proximate to the first side 210 of the pin housing 200, because the second projection 240 is disposed proximate to the second side 212 of the pin housing 200, and because the first and second projections 230, 240 are substantially similar (but mirror images of one another) in shape, the slot 250 is disposed centrally between the first side 210 and the second side 212. Moreover, because the first and second projections 230, 240 are disposed proximate to the top side 202 of the pin housing 200, the slot 250 is also disposed proximate to the top side 202 of the pin housing 200.

As best illustrated in FIGS. 18 and 20, the bottom side 238 of the first projection 230 includes a set of conductive contacts 260, while the bottom side 248 of the second projection 240 also includes a set of conductive contacts 262. In the embodiment illustrated, the first projection 230 includes four conductive contacts 260 that span longitudinally along the bottom side 238 from the first end 232 to the second end 234. Similarly, the second projection 240 also includes four conductive contacts 262 that span longitudinally along the bottom side 248 from the first end 242 to the second end 244 of the second projection 240. While both the first and second projections 230, 240 are illustrated as having four conductive contacts 260, 262, respectively, other embodiments of the pin housing 200 may include any number of conductive contacts disposed on the first and second projections 230, 240. As best illustrated in FIG. 18, disposed on the bottom side 238 of the first projection 230 proximate to the first end 232 is an angled or ramped surface 264. Similarly, disposed on the bottom side 248 of the second projection 240 proximate to the first end 242 is an angled or ramped surface 266. The ramped surfaces 264, 266 enable the first ends 232, 242, of the first and second projections 230, 240, respectively, to slide past the ends of projections of a pin housing of a second connector half 100(2) when the first connector half 100(1) is mated with the second connector half 100(2).

Returning to FIGS. 17-24, the pin housing 200 also includes a central protrusion 270 that extends from the first side 222 of the base portion 220 such that the central protrusion 270 is disposed proximate to the front side 206 and the bottom side 204 of the pin housing 200. Moreover, the central protrusion 270 is may extend from the first side 222 of the base portion 220 at a location that is equidistant from the first and second sides 210, 212 of the pin housing 200. The central protrusion 270 includes a first end 272 and an opposite second end 274. The second end 274 of the central protrusion 270 is coupled to the first side 222 of the base portion 220, while the first end 274 of the central protrusion 270 is a free end, uncoupled from the base portion 220. The central protrusion 270 further includes a top surface 276 and a bottom surface 278 opposite the top surface 276. As illustrated, the top surface 276 is a substantially undulating surface with a first inclining surface 280 disposed proximate to the first end 272, a second inclining surface 284 disposed proximate to the second end 274 of the central protrusion, and a declining surface 282 disposed between the first and second inclining surfaces 280, 284. Moreover, the central protrusion 270 may have a length L2 and a width W2. The length L2 of the central protrusion 270 may be substantially equal to the length L1 of the slot 250. In addition, the width W2 of the central protrusion 270 may be substantially equal to the width W1 of the slot 250. Thus, the slot 250 may be of a shape and dimension configured to receive the central protrusion 270 of another pin housing, as described in more detail below.

With reference in particular to FIG. 23, the first and second projections 230, 240 extend from the base portion 220 of the pin housing 220 such that the first and second projections 230, 240 are disposed substantially within the same horizontal plane X that traverses the first side 222 of the base portion 220 from the first side 210 to the second side 212 of the pin housing 220. The slot 250 that is disposed between the first and second projections 230, 240 is also disposed substantially within plane X. As illustrated, the central protrusion 270 extends from the base portion 220 of the pin housing 220 such that the central protrusion 270 is disposed substantially within plane Y that traverses the first side 222 of the base portion 220 from the first side 210 to the second side 212 of the pin housing 220, similar to that of plane X. As illustrated, Plane X and plane Y are parallel to one another. However, plane X is oriented closer to the top side 202 of the pin housing 200 than plane Y, while plane Y is oriented closer to the bottom side 204 of the pin housing 200 than plane X. Thus, plane X is disposed higher in height on the pin housing 200 than plane Y. It then follows that the first and second projections 230, 240, and the slot 250, which are all oriented along plane X, are disposed higher in height than the central protrusion 270, which is oriented along plane Y. Furthermore, the central projection 270 and the slot 250 are aligned with one another along plane Z, which traverses the first side 222 of the base portion 220 from the top side 202 to the bottom side 204 of the pin housing 200. As illustrated in FIG. 23, plane Z traverses the first side 222 of the base portion 220, and is perpendicular to both planes X and Y.

Figure 25:
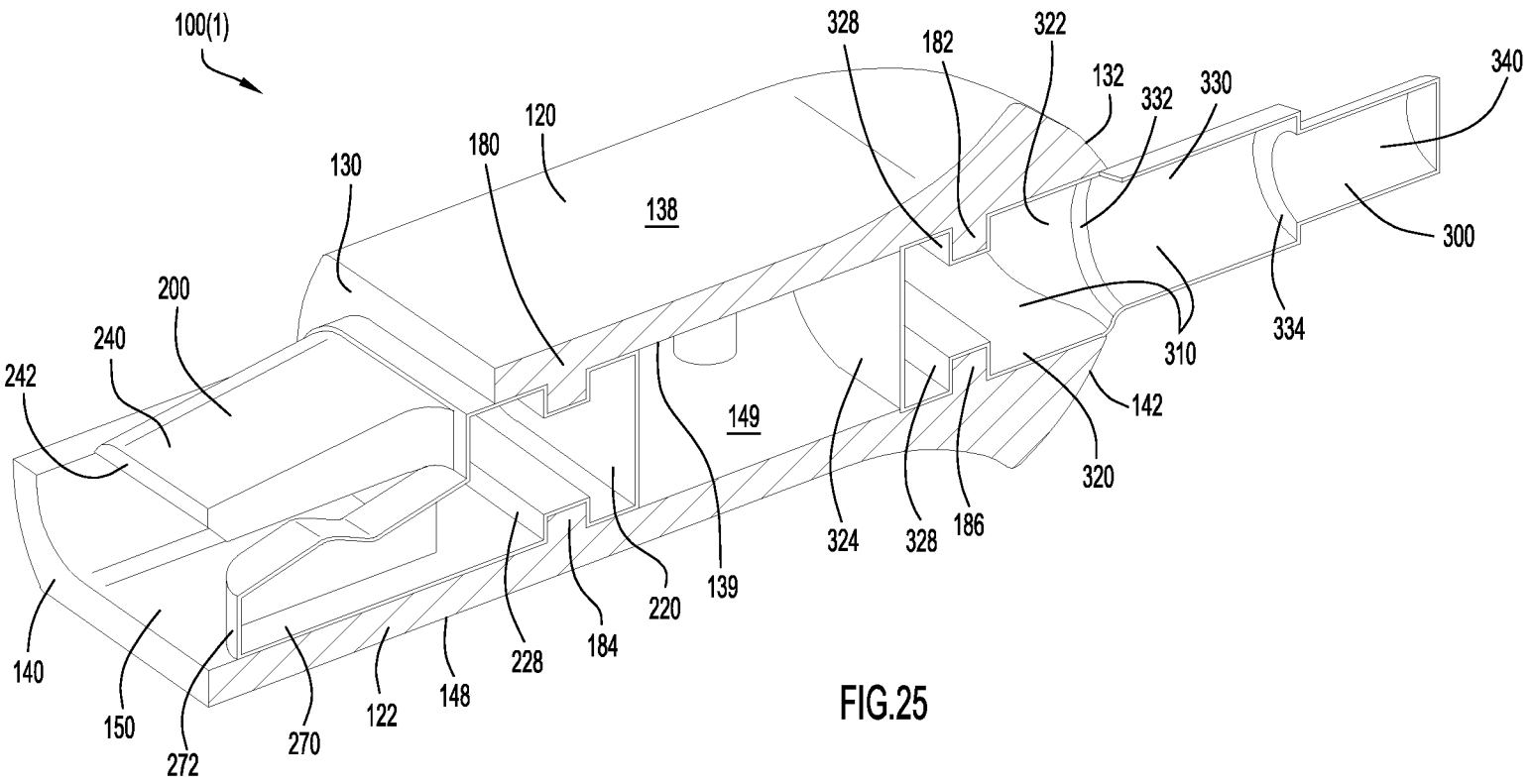
FIG. 25 is a cross-sectional view of the connector half illustrated in FIG. 8 taken along line C-C of FIG. 10.

With reference in particular to FIG. 25, a cross-sectional view taken along line C-C of FIG. 10 is shown, in which the pin housing 200 is coupled to the first and second housings 120, 122 such that the pin housing 200 is disposed proximate to the front side 106 of the first connector half 100(1), as previously explained. More specifically, the base portion 220 of the pin housing 200 is disposed between the first and second housings 120, 122, while the projections 230, 240 and the central protrusion 270 extend beyond the first end 130 of the first housing 120. As further illustrated, the central protrusion 270 extends across the platform 150 of the second housing 122 such that the first end 272 of the central protrusion 270 is disposed proximate to the first end 140 of the second housing 122. The first and second projections 230, 240 extend over the platform 150 (i.e., the first and second projections 230, 240 are spaced from the platform 150, but are disposed over the platform 150) with the first ends 232, 242 of the projections 230, 240, respectively, being disposed proximate to the first end 140 of the second housing 122.

As further illustrated in FIG. 25, the base portion 220 of the pin housing 200 is captured by the first and second housings 120, 122. More specifically, the forward protuberance 180 of the interior surface 139 of the first housing 120 and the forward protuberance 184 of the second housing 122 are disposed within the groove 228 of the base portion 220 of the pin housing 200. As previously explained, the forward protuberance 180 of the first housing 120 is aligned with the forward protuberance 184 of the second housing 122 such that the two forward protuberances 180, 184 collectively form a continuous protuberance extending around an interior of the first connector half 100(1) proximate to the first end 130 of the first housing 120. As also previously explained, the groove 228 is disposed within the sidewall 226 of the base portion 220 such that the groove 228 extends continuously around the base portion 220. Thus, as illustrated, the groove 228 is configured to receive the forward protuberances 180, 184 of the first and second housings 120, 122, respectively. The forward protuberances 180, 184 being disposed within the groove 228 of the base portion 220 couples and secures the pin housing 200 to the housings 120, 122.

Figure 26:
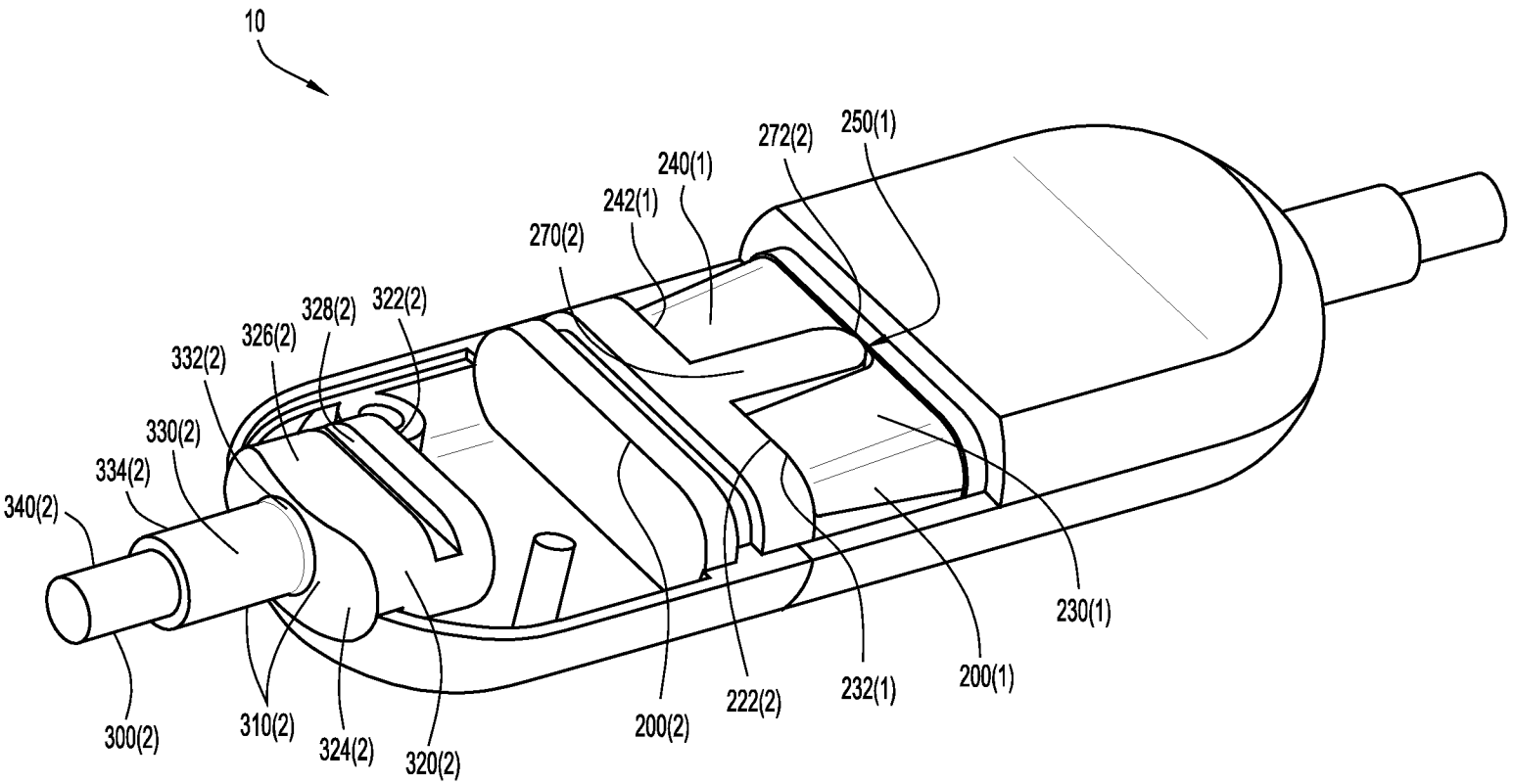
FIG. 26 is a perspective view of the hermaphroditic quick disconnect electrical connector illustrated in FIG. 1 with a portion of the housing of the hermaphroditic quick disconnect electrical connector removed.

As best illustrated in FIGS. 25 and 26, each of the half connectors 100(1), 100(2) includes a cable coupling 300 that couples the connectors to the end of a cable. As illustrated, the cable coupling 300 includes a base 310 and a cable portion 340. The base 310 includes a first portion 320 having a first side 322, a second opposite side 324, and a sidewall 326 spanning between the first and second sides 322, 324. Similar to the base 220 of the pin housing 200, the first portion 320 of the base portion 310 of the cable coupling 300 includes a groove 328 disposed within the sidewall 326. In some embodiments, the groove 328 may extend continuously around the first portion 320 of the base 310, while in other embodiments, the groove 328 may only extend partially around the first portion 320 of the base 310. As illustrated, the base 310 further includes a second portion 330 having a first side 332 and an opposite second side 334. The second portion 330 of the base 310 may be substantially cylindrical. Moreover, the first end 332 of the second portion 330 of the base 310 may be coupled to the second end 324 of the first portion 320 of the base 310 such that the second portion 330 extends rearwardly from the first portion 320. As further illustrated, the cable 340 may be coupled to the cable coupling 300 by extending into the cable coupling 300 through the second end 334 of the second portion 330 of the base 310.

Still referring to FIGS. 25 and 26, the cable coupling 300 is coupled to the rear side 108 of the first connector half 100(1) such that the first portion 320 of the base 310 of the cable coupling 300 is disposed between the first and second housings 120, 122 while the second portion 330 of the base 330 extends from the rear side 108 of the first connector half 100(1). As previously explained, the first housing 120 includes a cut-out portion 170 disposed in the second end 132 of the first housing 120, while the second housing 122 also includes a cut-out portion 172 disposed in the second end 142 of the second housing 122. The cut-out portion 170 of the first housing 120 aligns with the cut-out portion 172 of the second housing 122 to create an opening 174 on the rear side 108 of the first connector half 100(1). As illustrated, the first portion 320 of the base 310 of the cable coupling 300 is disposed between the first and second housings 120, 122 such that the cable coupling 300 extends outward from housings 120, 122 through the opening 174. Moreover, the first portion 320 of the base 310 of the cable coupling 300 may be disposed between the housings 120, 122 such that the second side 324 of the first portion 320 fills the opening 174 and is aligned with the second sides 134, 144 of the first and second housings 120, 122, respectively.

As best illustrated in FIG. 25, the first portion 320 of the base 310 of the cable coupling 300 is captured by the first and second housings 120, 122. More specifically, the rearward protuberance 182 of the interior surface 139 of the first housing 120 and the rearward protuberance 186 of the second housing 122 are disposed within the groove 328 of the first portion 320 of the base 310 of the cable coupling 300. As described above, the rearward protuberance 182 of the first housing 120 is aligned with the rearward protuberance 186 of the second housing 122 such that the two rearward protuberances 182, 186 collectively form a continuous protuberance extending around an interior of the first connector half 100(1) proximate to the second ends 132, 142 of the first and second housings 120, 122, respectively. As also previously described, the groove 328 is disposed within the sidewall 326 of the first portion 320 of the base 310. Thus, as illustrated, the groove 328 is configured to receive the rearward protuberances 182, 186 of the first and second housings 120, 122, respectively to secure the first portion 320 of the base 310 between the first and second protrusions 120, 122.

While not illustrated, the first side 322 of the first portion 320 of the base 310 of the cable coupling 300 may be electrically coupled to the second side 224 of the base portion 220 of the pin housing 200, and configured to transmit electrical signals between the pin housing 200 and the cable coupling 300.

Figure 27:
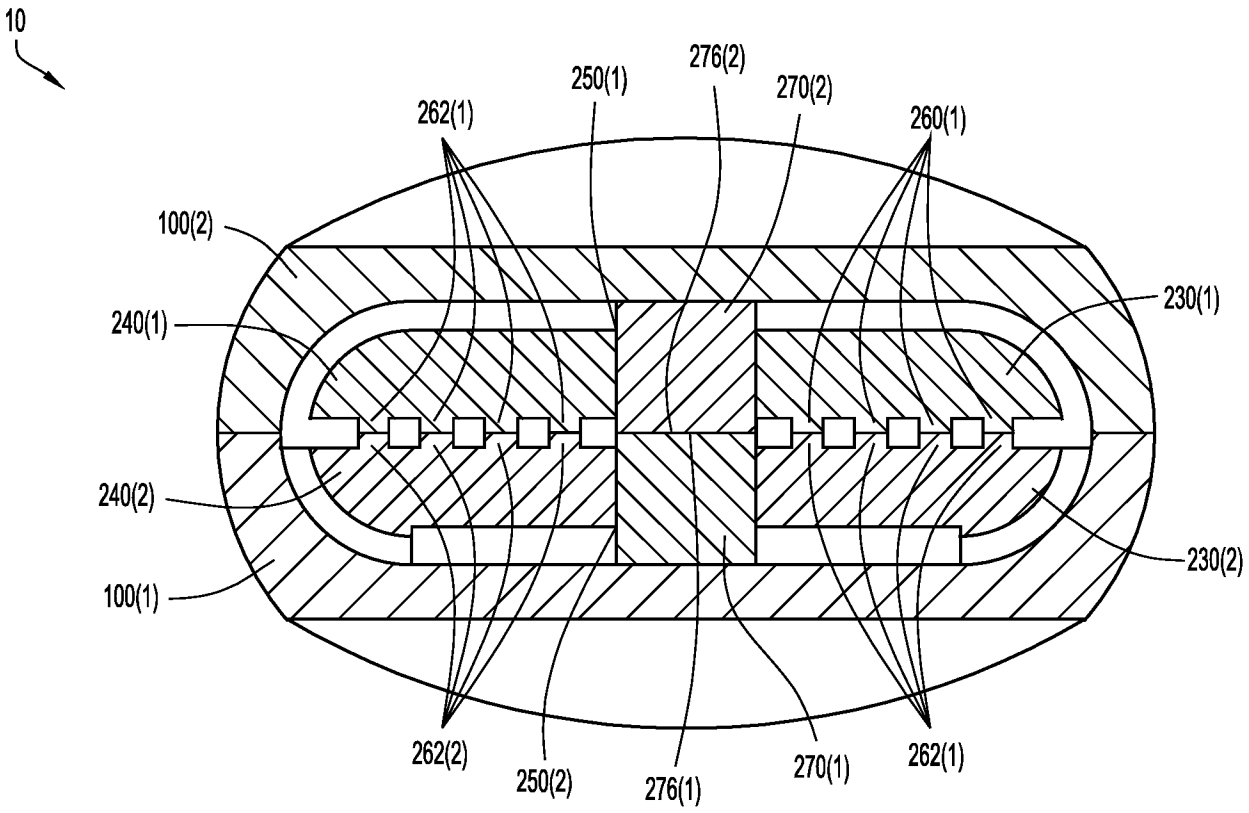
FIG. 27 is a cross-sectional view of the hermaphroditic quick disconnect electrical connector illustrated in FIG. 1 taken along line A-A of FIG. 2.
Figure 28:
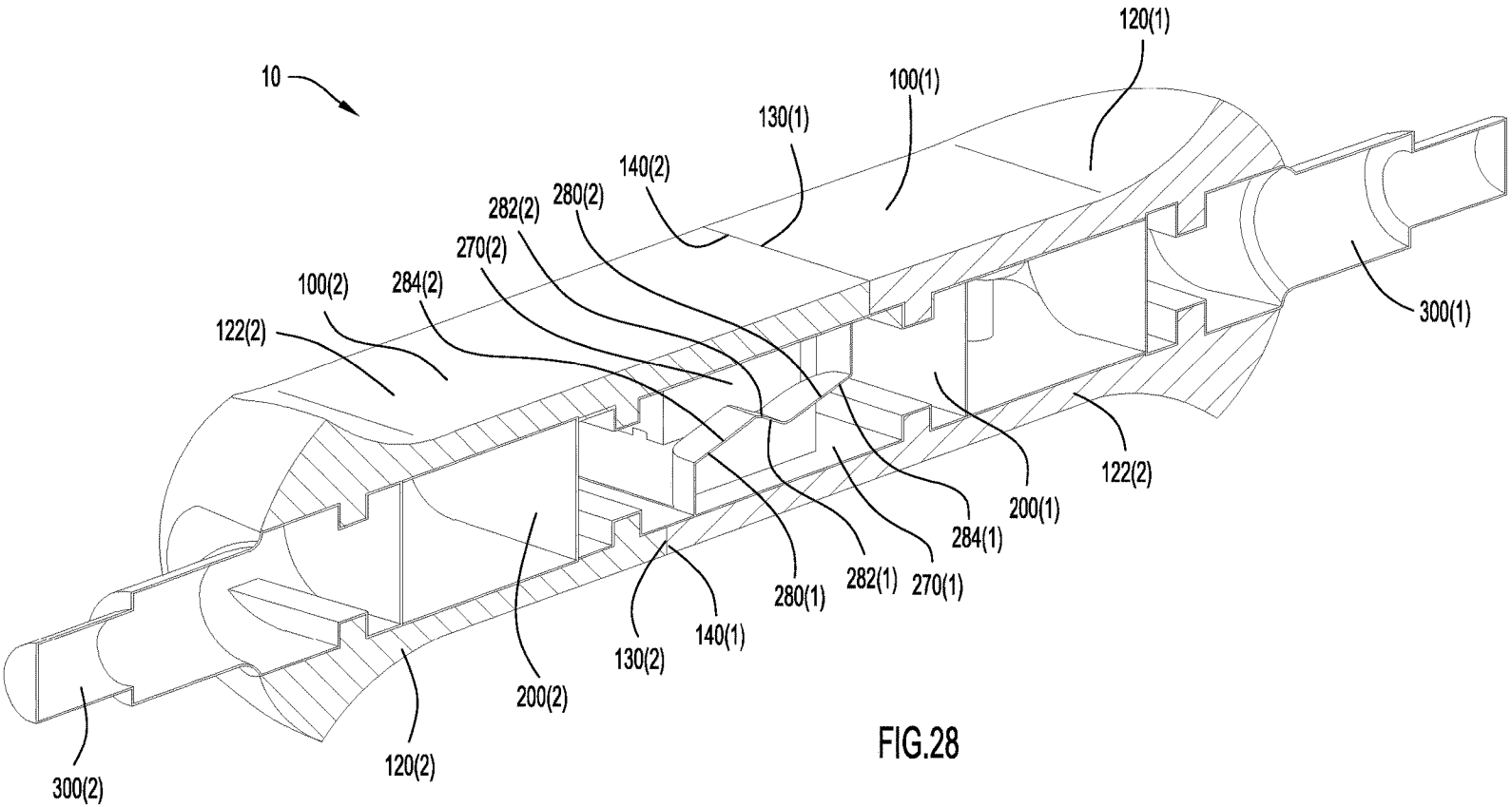
FIG. 28 is a cross-sectional view of the embodiment of the hermaphroditic quick disconnect electrical connector illustrated in FIG. 1 taken along line B-B of FIG. 2.

With reference now to FIGS. 26-28, illustrated is the interconnection of the first connector half 100(1) with the second connector half 100(2), and the pin housing 200(1) of the first connector half 100(1) with the pin housing 200(2) of the second connector half 100(2). FIG. 26 illustrates a perspective view of the connector 10 with the second housing 122(2) removed from the second connector half 100(2). FIG. 27 illustrates a cross-sectional view of the connector 10 taken along line A-A of FIG. 2, while FIG. 28 illustrates a cross-sectional view of the connector 10 taken along line B-B of FIG. 2. As described above, the first and second connector halves 100(1), 100(2) are identical to one another. Moreover, as explained in more detail below, the first and second connector halves 100(1), 100(2) are hermaphroditic and configured to be connected or coupled only to one another to facilitate the transmission of electronic signals through the connection (i.e., the connector halves 100(1), 100(2) are identical to one another may not be configured to connect to other cable connectors and capable of transmitting electronic signals).

As illustrated, when the first connector half 100(1) is connected to the second connector half 100(2), the second connector half (2) is inverted with respect to the first connector half 100(1) such that the first housing 120(1) of the first connector half 100(1) is aligned with the second housing 122(2) of the second connector half 100(2). When coupled to one another, the first end 130(1) of the first housing 120(1) of the first connector half 100(1) is in abutment with the first end 140(2) of the second housing 122(2) of the second connector half 100(2), while the first end 130(2) of the first housing 120(2) of the second connector half 100(2) is in abutment with the first end 140(1) of the second housing 122(1) of the first connector half 100(1). Furthermore, as best illustrated in FIG. 26, because the second connector half 100(2) is inverted with respect to the first connector half 100(1), when coupled to one another, the central protrusion 270(1) of the first connector half 100(1) is disposed within the slot 250(2) of the second connector half 100(2), while the central protrusion 270(2) of the second connector half 100(2) is disposed within the slot 250(1) of the first connector half 100(1). Moreover, the first ends 232(1), 242(1) of the first and second projections 230(1), 240(1) of the first connector half 100(1) are disposed proximate the first side 222(2) of the base 220(2) of the second connector half 100(2), while the first ends 232(2), 242(2) of the first and second projections 230(2), 240(2) of the second connector half 100(2) are disposed proximate the first side 222(1) of the base 220(1) of the second connector half 100(1).

As best illustrated in FIG. 27, when the first and second connector halves 100(1), 100(2) are connected to one another, the bottom sides 239(1), 249(1) of the first and second projections 230(1), 240(1), respectively, are oriented to face the bottom sides 239(2), 249(2) of the first and second projections 230(2), 240(2), respectively. More specifically, as best illustrated in FIG. 9, the conductive contacts 260(1) of the first projection 230(1) of the first connector half 100(1) are in contact or abutment with the conductive contacts 260(2) of the first projection 230(2) of the second connector half 100(2). Similarly, the conductive contacts 262(1) of the second projection 240(1) of the first connector half 100(1) are in contact or abutment with the conductive contacts 262(2) of the second projection 240(2) of the second connector half 100(2). The abutment of the conductive contacts 260(1), 260(2), 262(1), 262(2) with one another facilitates the transmission of data signals between the connector halves 100(1), 100(2).

Still referring to FIGS. 27 and 28, when the first and second connector halves 100(1), 100(2) are connected to one another, the top surface 276(1) of the central protrusion 270(1) of the first connector half 100(1) is in abutment with the top surface 276(2) of the central protrusion 270(2) of the second connector half 100(2). More specifically, the first inclined surface 280(1) of central protrusion 270(1) is in abutment with the second inclined surface 284(2) of central protrusion 270(2). Similarly, the first inclined surface 280(2) of central protrusion 270(2) is in abutment with the second inclined surface 284(1) of central protrusion 270(1). Furthermore, the declined surface 282(1) of central protrusion 270(1) is in abutment with the declined surface 282(2) of central protrusion 270(2). Thus, the undulating top surface 276(1) of the central protrusion 270(1) of the first connector half 100(1) is configured to mate with the undulating top surface 27692) of the central protrusion 270(2) of the second connector half 100(2). The mating of these two top surfaces 276(1), 276(2) of the central protrusions 270(1), 270(2), respectively, secures of the first connector half 100(1) and the second connector half 100(2) to one another. In other words, the mating of the surfaces 280(1), 282(1), 284(1) of the central protrusion 270(1) with the surfaces 280(2), 282(2), 284(2) of the central protrusion 270(2) prevents the top surfaces 276(1), 276(2) of the central protrusion 270(1), 270(2), respectively, from sliding along one another without a user applying some degree of force to the connector halves 100(1), 100(2) (i.e., to either push the halves 100(1), 100(2) together or to pull the halves 100(1), 100(2) apart from one another).

With the mating and undulating top surfaces 276(1), 276(2) of the central protrusion 270(1), 270(2), respectively, securing the connector halves 100(1), 100(2) to one another, continuous and affirmative electrical contact between the conductive contacts 260(1), 260(2) and the conductive contacts 262(1), 262(2) is maintained. Because the pin housings 200(1), 200(2) of the connector halves 100(1), 100(2) are identical to one another and are configured to securely mate with one another, movement of one of the cables 340(1), 340(2) would not cause an interruption of the electrical contact between the conductive contacts 260(1), 260(2), 262(1), 262(2).

In summary, disclosed herein is a hermaphroditic quick disconnect electrical connector. The connector may include a housing, a first projection, a second projection, and a central protrusion. The housing may include a first side, an opposite second side, a top side, and an opposite bottom side. The first projection may extend from the first side of the housing proximate to the top side of the housing. The second projection may extend from the first side of the housing proximate to the top side of the housing such that the first and second projections are spaced from one another by a slot. The central protrusion may extend from the first side of the housing proximate to the bottom side of housing.

Also disclosed herein is a pin housing for an electrical connector. The pin housing may include a base, a first projection, a second projection, a plurality of conductive contacts, and a central protrusion. The base may have a first side and an opposite second side. The first projection may extend from the first side of the base in a first plane that traverses the first side of the base. The second projection may also extend from the first side of the base in the first plane, and may be spaced from the first projection by a slot. The plurality of conductive contacts may be disposed on both the first projection and the second projections. Furthermore, the central protrusion may extend from the first side of the base in a second plane that traverses the first side of the base, and where the second plane is offset from the first plane.

In another embodiment, a hermaphroditic electrical connector has a first connector half and a second connector half configured to mate with one another. Each of the connector halves may include a housing a first projection, a second projection, and a central protrusion. The housing may include a first side, an opposite second side, a top side, and an opposite bottom side. The first projection may extend from the first side of the housing proximate to the top side of the housing. The second projection may extend from the first side of the housing proximate to the top side of the housing such that the first and second projections are spaced from one another by a slot. The central protrusion may extend from the first side of the housing proximate to the bottom side of housing.

The above description is intended by way of example only. Various modifications and structural changes may be made therein without departing from the scope of the concepts described herein and within the scope and range of equivalents of the claims.

What is claimed is:

1. An electrical connector comprising:

a housing having a first side, an opposite second side, a top side, and an opposite bottom side;

a first projection extending from the first side of the housing proximate to the top side of the housing;

a second projection extending from the first side of the housing proximate to the top side of the housing, the first and second projections being spaced from one another by a slot; and a central protrusion extending from the first side of the housing proximate to the bottom side of housing, wherein the central protrusion includes a top surface that contains a series of inclined and declined surfaces, the inclined surfaces of the central protrusion of the electrical connector are configured to be in abutment with corresponding inclined surfaces of a mating central protrusion of a mating electrical connector.

2. The electrical connector of claim 1, wherein the central protrusion includes a first end and a second end, and the series of inclined and declined surfaces of the central protrusion further comprises:

a first inclined surface disposed proximate to the first end of the central protrusion;

a second inclined surface disposed proximate to the second end of the central protrusion; and a declined surface disposed between the first inclined surface and the second inclined surface.

3. The electrical connector of claim 1, further comprising a first plurality of conductive contacts disposed on a bottom surface of the first projection.

4. The electrical connector of claim 3, further comprising a second plurality of conductive contacts disposed on a bottom surface of the second projection.

5. The electrical connector of claim 1, wherein the housing includes a top half member that forms the top side of the housing, and a bottom half member that forms the bottom side of the housing.

6. The electrical connector of claim 5, wherein the top half member has a first length and the bottom half member has a second length, the first length being less than the second length such that a platform is formed by a portion of an interior surface of the bottom half member that extends beyond the top half member on the first side of the housing.

7. The electrical connector of claim 6, wherein the central protrusion is disposed against the interior surface of the platform of the bottom half member of the housing, and the first and second projections are spaced from the interior surface of the platform of the bottom half member of the housing.

8. A pin housing for an electrical connector, the pin housing comprising:

a base having a first side and an opposite second side;

a first projection extending from the first side of the base in a first plane that traverses the first side of the base;

a second projection extending from the first side of the base in the first plane and spaced from the first projection by a slot;

a plurality of conductive contacts disposed on the first and second projections; and a central protrusion extending from the first side of the base in a second plane that traverses the first side of the base, the second plane being offset from the first plane, wherein the central protrusion includes a top surface that contains a series of inclined and declined surfaces, the inclined surfaces of the central protrusion of the pin housing of the electrical connector are configured to be in abutment with corresponding inclined surfaces of a mating central protrusion of a mating pin housing of a mating electrical connector.

9. The pin housing of claim 8, wherein the base of the pin housing includes a groove disposed within a sidewall of the base, the sidewall spanning between the first side and the second side.

10. The pin housing of claim 8, wherein the central protrusion includes a first length and a first width, and the slot includes a second length and a second width, the first length being substantially equal to the second length, and the first width being substantially equal to the second width.

11. The pin housing of claim 8, wherein the central protrusion and the slot are aligned in a third plane that traverses the first side of the base and is perpendicular to the first and second planes.

12. The pin housing of claim 8, wherein the central protrusion includes a first end and a second end, and the series of inclined and declined surfaces of the central protrusion further comprises:

a first inclined surface disposed proximate to the first end of the central protrusion;

a second inclined surface disposed proximate to the second end of the central protrusion; and a declined surface disposed between the first inclined surface and the second inclined surface.

13. The pin housing of claim 8, wherein the set of conductive contacts is disposed on a bottom surface of the first projection and on a bottom surface of the second projection.

14. The pin housing of claim 13, wherein the first projection has a first end coupled to the first side of the base, and a second end opposite of the first end, the bottom surface having a ramped surface disposed proximate to the second end of the first projection.

15. The pin housing of claim 13, wherein the second projection has a first end coupled to the first side of the base, and a second end opposite of the first end, the bottom surface having a ramped surface disposed proximate to the second end of the second projection.

16. A hermaphroditic electrical connector having a first connector half and a second connector half configured to mate with one another, each of the first connector half and the second connector half comprising:

a housing have a first side, an opposite second side, a top side, and an opposite bottom side;

a first projection extending from the first side of the housing proximate to the top side of the housing;

a second projection extending from the first side of the housing proximate to the top side of the housing, the first and second projections being spaced from one another by a slot; and a central protrusion extending from the first side of the housing proximate to the bottom side of housing, wherein the central protrusion includes a top surface that contains a series of inclined and declined surfaces, and when the first connector half is mated with the second connector half, the inclined surfaces of the central protrusion of the first connector half are in abutment with the inclined surfaces of the central protrusion of the second connector half.

17. The hermaphroditic electrical connector of claim 16, wherein, when the first connector half is mated with the second connector half, the slot of the first connector half is configured to receive the central protrusion of the second connector half, and the slot of the second connector half is configured to receive the central protrusion of the first connector half.

18. The hermaphroditic electrical connector of claim 16, wherein, when the first connector half is mated with the second connector half, the first projection of the first connector half is in abutment with the first projection of the second connector half, and the second projection of the first connector half is in abutment with the second projection of the second connector half.

19. The hermaphroditic electrical connector of claim 16, wherein the second side of the housing is configured to couple to a cable.

20. The hermaphroditic electrical connector of claim 16, wherein the central protrusion includes a first end and a second end, and the series of inclined and declined surfaces of the central protrusion further comprises:

a first inclined surface disposed proximate to the first end of the central protrusion;

a second inclined surface disposed proximate to the second end of the central protrusion; and a declined surface disposed between the first inclined surface and the second inclined surface.

* * * * *